US005455003A

United States Patent [19]

Pickens et al.

[11] Patent Number: 5,455,003

[45] Date of Patent: * Oct. 3, 1995

[54] AL-CU-LI ALLOYS WITH IMPROVED CRYOGENIC FRACTURE TOUGHNESS

[75] Inventors: Joseph R. Pickens, Glenelg, Md.; William T. Tack, Littleton, Colo.

[73] Assignee: Martin Marietta Corporation, Bethesda, Md.

[ * ] Notice: The portion of the term of this patent subsequent to Nov. 9, 2010 has been disclaimed.

[21] Appl. No.: 103,662

[22] Filed: Aug. 10, 1993

Related U.S. Application Data

[63] Continuation-in-part of Ser. No. 32,158, Mar. 12, 1993, abandoned, which is a continuation of Ser. No. 493,255, Mar. 14, 1990, abandoned, which is a continuation-in-part of Ser. No. 327,666, Mar. 23, 1989, Pat. No. 5,259,897, which is a continuation-in-part of Ser. No. 233,705, Aug. 18, 1988, abandoned.

[51] Int. Cl.[6] ..... C22C 21/12

[52] U.S. Cl. ..... 420/529; 148/695; 148/698; 148/699; 148/700; 148/701; 148/416; 148/417; 148/418; 148/438; 148/439; 420/531; 420/532; 420/533; 420/539; 420/540; 420/541; 420/542; 420/543; 420/545; 420/552; 420/553

[58] Field of Search ..... 420/529, 531, 420/532, 533, 539, 540, 541, 542, 543, 545, 552, 553; 148/695, 698, 699, 700, 701, 416, 417, 418, 438, 439

[56] References Cited

U.S. PATENT DOCUMENTS

| | | | |
|---|---|---|---|
| 2,381,219 | 8/1945 | LeBaron | 420/529 |
| 2,915,391 | 12/1959 | Criner | 148/439 |
| 3,306,717 | 2/1967 | Lindstrand | 420/534 |
| 4,526,630 | 4/1985 | Field | 148/700 |
| 4,624,717 | 11/1986 | Miller | 148/415 |
| 4,648,913 | 3/1987 | Hunt, Jr. et al. | 148/415 |
| 4,752,343 | 6/1988 | Dubost et al. | 148/417 |
| 4,758,286 | 7/1988 | Dubost et al. | 148/417 |
| 4,772,342 | 9/1988 | Polmear | 148/418 |
| 4,795,502 | 1/1989 | Cho | 148/417 |

(List continued on next page.)

FOREIGN PATENT DOCUMENTS

| | | |
|---|---|---|
| 0273600 | 7/1988 | European Pat. Off. . |
| 0325937 | 1/1989 | European Pat. Off. . |
| 2134925 | 8/1984 | United Kingdom . |
| 9111540 | 8/1991 | WIPO . |
| WO91/11540 | 8/1991 | WIPO . |
| 9214855 | 9/1992 | WIPO . |

OTHER PUBLICATIONS

"Aluminum–Lithium", *The Effect of Zn on Nucleation in Al–Cu–Li–Ag–Mg Alloy, Weldalite 049 (X2094)*, J. R. Pickens, L. S. Kramer, T. J. Langan, F. H. Heubaum, Martin Marietta Laboratories, Baltimore, Md., USA, vol. 1, 1991, pp. 357–362.

"Registration Record of Aluminum Association Designations and Chemical Composition Limits for Wrought Aluminum and Wrought Aluminum Alloys," Revised Jan. 1989, the Alum. Assoc., Inc., pp. 2–8+12–15.

"Aging Phenomena of Al–Li–Mg Alloy Affected by Additional Elements," Hayashi et al, Journal of Japan Institute of Light Metals, vol. 32, No. 7, Jul. 1982, pp. 350–355 (with full translation).

*Primary Examiner*—David A. Simmons
*Assistant Examiner*—Robert R. Koehler
*Attorney, Agent, or Firm*—Gay Chin; Alan G. Towner; Brian J. Rees

[57] ABSTRACT

A method is disclosed for the production of aluminum-copper-lithium alloys that exhibit improved strength and fracture toughness at cryogenic temperatures. Improved cryogenic properties are achieved by controlling the composition of the alloy, along with processing parameters such as the amount of cold-work and artificial aging. The ability to attain substantially equal or greater strength and fracture toughness at cryogenic temperature in comparison to room temperature allows for use of the alloys in cryogenic tanks for space launch vehicles and the like.

39 Claims, 7 Drawing Sheets

U.S. PATENT DOCUMENTS

| | | | |
|---|---|---|---|
| 4,797,165 | 1/1989 | Bretz et al. | 148/12.7 A |
| 4,806,174 | 2/1989 | Cho et al. | 148/415 |
| 4,812,178 | 3/1989 | Dubost | 148/415 |
| 4,816,087 | 3/1989 | Cho | 148/415 |
| 4,832,910 | 5/1989 | Rioja et al. | 420/528 |
| 4,840,682 | 6/1989 | Curtis et al. | 148/415 |
| 4,840,683 | 6/1989 | Dubost | 148/417 |
| 4,844,750 | 7/1989 | Cho et al. | 148/12.7 A |
| 4,848,647 | 7/1989 | Gentry et al. | 420/532 |
| 4,869,870 | 9/1989 | Rioja et al. | 420/532 |
| 5,032,359 | 7/1991 | Pickens et al. | 420/533 |
| 5,116,572 | 5/1992 | Narayanan et al. | 420/533 |
| 5,122,339 | 6/1992 | Pickens et al. | 420/533 |
| 5,137,686 | 8/1992 | Rioja et al. | 420/528 |
| 5,151,136 | 9/1992 | Witters et al. | 148/689 |
| 5,259,897 | 11/1993 | Pickens et al. | 148/417 |

AL-CU-LI ALLOYS WITH IMPROVED CRYOGENIC FRACTURE TOUGHNESS

CROSS REFERENCE TO RELATED APPLICATIONS

This application is a Continuation-In-Part of U.S. patent application Ser. No. 08/032,158, now abandoned, filed Mar. 12, 1993, which is a continuation of U.S. application Ser. No. 07/493,255 filed Mar. 14, 1990, now abandoned, which is a Continuation-In-Part of U.S. patent application Ser. No. 07/327,666 filed Mar. 23, 1989, now U.S. Pat. No. 5,259,897 Continuation-In-Part of U.S. patent application Ser. No. 07/233,705 filed Aug. 18, 1988, now abandoned.

FIELD OF THE INVENTION

The present invention relates to aluminum-copper-lithium alloys having improved fracture toughness at cryogenic temperatures. More particularly, through control of composition and processing parameters, alloys are provided that exhibit improved fracture toughness and strength at low temperatures, making them suitable for use in cryogenic tanks for space launch vehicles and the like.

BACKGROUND OF THE INVENTION

Aluminum-copper-lithium alloys are under consideration as replacements for conventional aluminum alloys in launch systems. Currently, launch vehicles are constructed primarily from Aluminum Association registered alloys 2014 (Titan) and 2219 (Space Shuttle External Tank). Most of the dry weight of such launch systems, i.e., excluding propellant, is in propellant containment. For state of the art systems such as the Space Shuttle External Tank and the planned Titan IV cryogenic upper stage, the preferred propellant system is liquid hydrogen and liquid oxygen, which are each cryogenic liquids. It is therefore important for the structural alloy for such propellant containment to have both high strength and high toughness at cryogenic service temperatures. Furthermore, it is particularly advantageous for the alloy to have substantially equal or greater strength and toughness at cryogenic temperatures than at ambient temperature in both the parent alloy and any weldments. The ability to achieve higher fracture toughness and strength at cryogenic temperatures enables the structural proof test for the tank to be conducted more inexpensively at ambient rather than at cryogenic temperatures. If both strength and toughness are substantially the same or greater at cryogenic temperatures, a successful room temperature proof test ensures that neither strength-overload-induced nor toughness-limited-induced failure will occur at cryogenic service temperatures.

Cold work induced after solution heat treatment and quenching but before artificial aging is known to affect the mechanical properties of Al—Cu and Al—Cu—Li alloys. The most common way to induce such cold work is by plastically stretching axisymmetric product forms such as extrusions, sheet, and plate. The stretch, typically performed at room temperature, serves the dual function of straightening the product by plastic offset and providing dislocations that serve as nucleation sites for high-aspect-ratio strengthening precipitates, e.g., platelets, laths, etc., thereby increasing strength. Stretch is also known to increase room temperature toughness in Al—Cu and Al—Cu—Li alloys, but its effect on cryogenic toughness has not been reported to our knowledge.

Several aluminum-copper-lithium alloys have been commercialized. These include Aluminum Association (AA) registered alloys 2020, 2090, 2091, 2094, 2095, 2195, and 8090.

Alloy 2020 has a nominal composition, in weight percent, of Al—4.5Cu—1.1Li—0.5Mn—0.2Cd and was registered in the 1950's. Although the alloy possessed a relatively low density and developed high strength, it also possessed very low levels of fracture toughness and ductility. These problems along with processing difficulties led to the withdrawal of the alloy from the Aluminum Association register.

Alloy 2090 comprising Al—(2.4–3.0)Cu —1.9–2.6)Li—(0–0.25)Mg—0.12Zr was designed as a low density replacement for high strength alloys such as 2024 and 7075. Although this alloy develops relatively high strength, it also possesses poor short transverse fracture toughness and poor short transverse ductility associated with delamination problems and has not yet had wide range commercial success.

Alloy 2091 comprising Al—(1.8–2.5)Cu— (1.7–2.3)Li—(1.1–1.9)Mg—0.12Zr was designed as a high strength, high ductility alloy. However, at heat treated conditions that produce maximum strength, ductility is relatively low in the short transverse direction. Additionally, the strength achieved by alloy 2091 in non-cold-worked tempers is below the strength attained by the alloy in cold-worked tempers.

Alloy 8090 comprising Al—(1.0–1.6)Cu—(2.2–2.7)Li—(0.6–1.3)Mg—0.12Zr was designed for aircraft applications in which exfoliation corrosion resistance and damage tolerance were required. However, alloy 8090's limited strength capability and poor fracture toughness have prevented the alloy from becoming a widely accepted alloy for aerospace and aircraft applications.

Alloy 2094 comprises Al—(4.4–5.2)Cu—(0.8– 1.5)Li—(0.25–0.6)Mg—(0.25–0.6)Ag—0.25max. Zn—0.1max.Mn—(0.04–0.18)Zr, while alloy 2095 comprises Al—(3.9–4.6)Cu—(1.0–1.6)Li—(0.25–0.6)Mg—(0.25–0.6)Ag—0.25max.Zn—0.10max.Mn—(0.04–0.18)Zr. Alloy 2195 is similar to alloy 2095, but has slightly lower Cu and Li limits. These alloys possess exceptional properties such as ultra-high strength, high modulus, good weldability, etc.

U.S. Pat. Nos. 5,032,359 and 5,122,339 and U.S. patent application Ser. Nos. 07/327,666 filed Mar. 23, 1989, 07/493,255 filed Mar. 14, 1990 and 07/471,299 filed Jan. 26, 1990, each of which are hereby incorporated by reference, disclose aluminum alloys containing copper, lithium, magnesium and other alloying additions. These alloys have been found to possess very favorable properties such as high strength, high modulus, good weldability and good natural aging response.

In view of the technological importance of using improved alloys at cryogenic temperatures, it would be desirable to provide a low density, aluminum-base alloy that has higher strength and fracture toughness relative to conventional aluminum alloys and both increased strength and increased fracture toughness at cryogenic temperatures in comparison to room temperature. The present invention has been developed in view of the foregoing and provides aluminum-copper-lithium alloys within defined compositional ranges that exhibit improved combinations of cryogenic fracture toughness and strength when processed in accordance with the method of the present invention.

SUMMARY OF THE INVENTION

An object of the present invention is to provide a method of producing an aluminum-copper-lithium alloy that possesses improved fracture toughness and strength at cryogenic temperatures in comparison to room temperature.

Another object of the present invention is to provide a method of increasing the cryogenic fracture toughness and strength of an aluminum-base alloy, the method comprising the steps of providing a solution heat treated and quenched aluminum-base alloy within certain compositional ranges, working the alloy and artificially aging the alloy a sufficient amount to produce the desired increase in strength and fracture toughness at cryogenic temperatures.

Another object of the present invention is to provide an aluminum-copper-lithium alloy having improved fracture toughness and strength at cryogenic temperatures in comparison to room temperature.

Another object of the present invention is to provide a wrought aluminum-base alloy having increased cryogenic fracture toughness and strength, wherein the alloy is worked and artificially aged a sufficient amount to achieve the desired increase in fracture toughness and strength at cryogenic temperatures. In addition, the amounts of copper, lithium and other elements present in the alloy are controlled in order to achieve the desired improvement in properties at cryogenic temperatures.

Another object of the present invention is to provide a container for holding cryogenic materials such as liquid hydrogen, liquid oxygen, and liquid nitrogen, wherein the container is made of an aluminum-copper-lithium alloy that possesses improved fracture toughness and strength at cryogenic service temperatures.

In accordance with the present invention then, in one aspect there is provided a method for producing an improved aluminum-based alloy comprising the steps of:

a) providing a solution heat treated and quenched aluminum-base alloy consisting essentially of from 2.0 to 6.5 weight percent Cu, from 0.2 to 2.7 weight percent Li, and the balance aluminum and incidental impurities; and b) at least one of working and artificially aging said alloy in an amount sufficient to provide strength and fracture toughness to said alloy at cryogenic temperature substantially equal to or greater than the strength and fracture toughness at room temperature.

In accordance with another embodiment of the invention there is provided a wrought aluminum-base alloy consisting essentially of from 2.8 to 4.8 weight percent Cu, from 0.4 to 1.5 weight percent Li, from 0.2 to 1.0 weight percent Mg, and the balance aluminum and incidental impurities, wherein said alloy is worked, artificially aged, or worked and artificially aged an amount sufficient to provide strength and fracture toughness to said alloy at cryogenic temperature substantially equal to or greater than the strength and fracture toughness at room temperature.

In accordance with still another embodiment of the present invention, there is provided a cryogenic material-holding container made from an alloy consisting essentially of from 2.8 to 4.5 weight percent Cu, from 0.4 to 1.5 weight percent Li, from 0.2 to 1.0 weight percent Mg, and the balance aluminum and incidental impurities, wherein said alloy is worked, artificially aged, or worked and artificially aged an amount sufficient to provide strength and fracture toughness to said alloy at cryogenic temperature substantially equal to or greater than the strength and fracture toughness at room temperature.

DETAILED DESCRIPTION OF THE INVENTION

Figure 1:
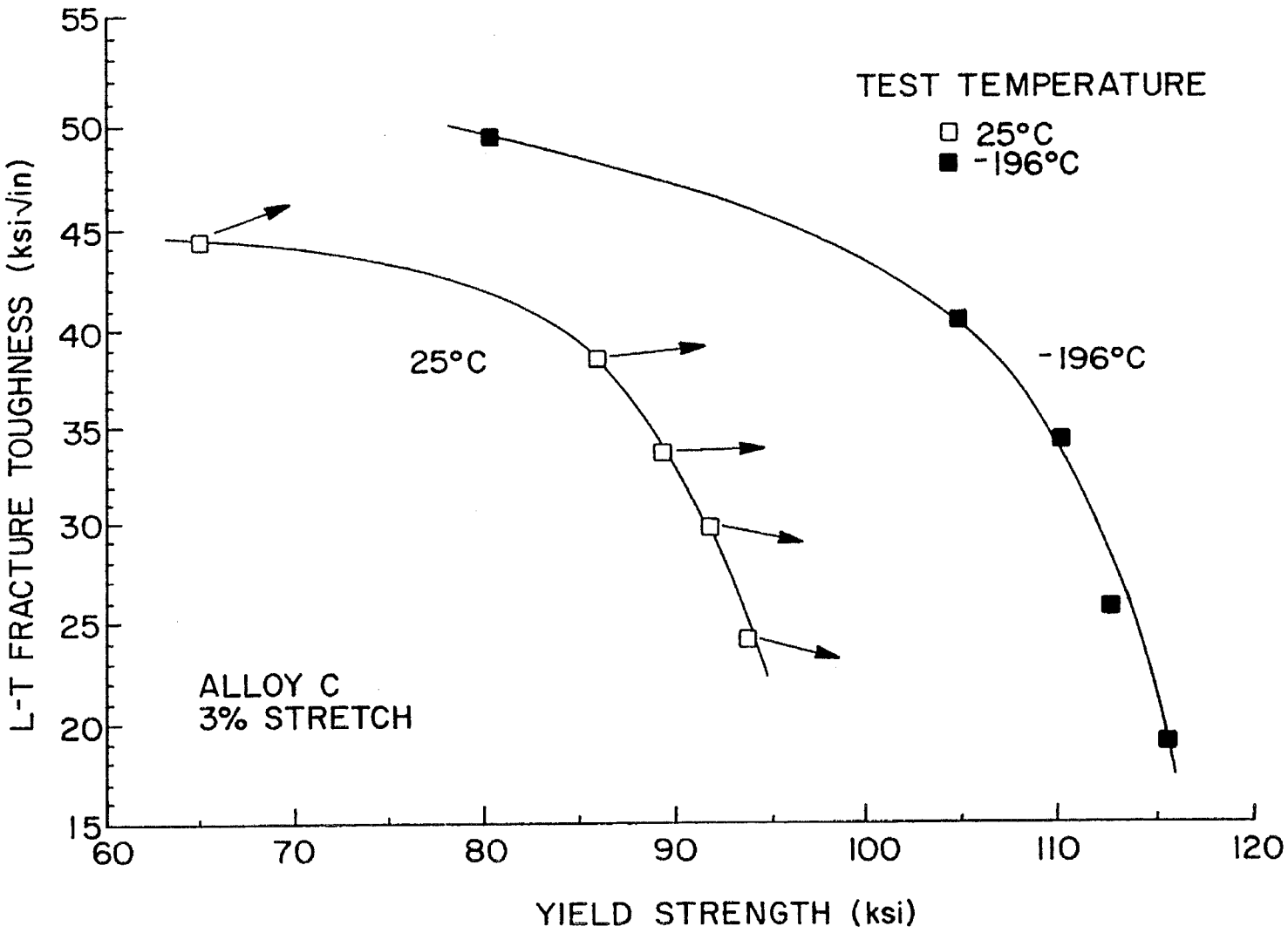
FIG. 1 is a graph of fracture toughness versus yield strength for an alloy at room temperature and at cryogenic temperature. The graph demonstrates that fracture toughness of the alloy increases at cryogenic temperature when the alloy is artificially aged to a lower yield strength, but cryogenic fracture toughness decreases relative to that at room temperature when the alloy is artificially aged to a higher yield strength.

The present invention relates to the control of composition, fabrication and heat treating of aluminum-copper-lithium alloys in order to produce improved cryogenic fracture toughness and strength properties. In accordance with the present invention, a wrought aluminum-copper-lithium alloy is provided in which fracture toughness at cryogenic temperatures is higher than, or equal to, that at room temperature. In addition, strength at cryogenic temperatures is higher than that at room temperature. This combination of improved fracture toughness and strength at cryogenic temperatures is defined in accordance with the present invention as the "desirable cryogenic fracture toughness trend". The desirable trend can be attained by controlling the levels of copper and lithium in the alloys, and by controlling processing parameters such as stretch, aging and recrystallization of the alloys.

The term "cryogenic temperature" is defined in accordance with the present invention to include temperatures significantly below room temperature and typically below 0° C. Thus, the temperatures at which hydrogen (−253° C.), oxygen (−183° C.) and nitrogen (−196° C.) become liquid are included as cryogenic temperatures. For purposes of experimental evalution, a temperature of −196° C. is considered as a cryogenic temperature. Room temperature is defined in accordance with its common usage and includes temperatures of from about 20° to about 25° C. For purposes of experimental evaluation, a temperature of 25° C. is considered to be room temperature.

In addition to aluminum, copper and lithium, the alloys of the present invention may, in certain preferred embodiments, contain magnesium, silver, zinc, and combinations thereof, along with other alloying elements such as grain refiners, dispersoid forming elements and nucleation aids. Compositional ranges of the alloying additions of the present alloys are given below in Table 1. Unless stated otherwise, all composition values herein are in weight percent.

TABLE 1

| | Compositional Ranges of Alloys (wt. %, balance Al) | | | | |
|---|---|---|---|---|---|
| | Cu | Li | Ag | Mg | Zn |
| Broad | 2.0–6.5 | 0.2–2.7 | 0–4.0 | 0–4.0 | 0–3.0 |
| Preferred | 2.8–4.8 | 0.4–1.5 | 0–0.8 | 0.2–1.0 | 0–1.0 |
| Most Pref. | 3.0–4.5 | 0.7–1.1 | 0–0.6 | 0.3–0.6 | 0–0.75 |

Other alloying additives such as Zr, Ti, Cr, Mn, Hf, Nb, B, Fe, Y, La, V, Mo, Se, Co, Ni, Cd, In, Sn, Ge and combinations thereof may be included in amounts up to a total of about 10 weight percent as long as such additions do not significantly impair the attainment of the desirable cryogenic fracture toughness trend. Grain refiners such as Zr, Ti, Cr, Mn, Hf, Nb, B, V and $TiB_2$ may be included in a preferred total amount of from about 0.01 to about 1.0 weight percent and more preferably from about 0.08 to about 0.3 weight percent. The amount of grain refining elements and/or dispersoid forming elements may be increased in excess of 1.0% when powder metallurgy processing is employed, e.g., rapid solidification, mechanical alloying, and reaction milling. Zirconium and titanium are particularly preferred as grain refining additions, with Zr also being beneficial as a recrystallization inhibitor.

In accordance with the present invention, alloys were prepared having compositions as set forth in Table 2. Although not listed in Table 2, aluminum makes up the balance of each composition.

TABLE 2

| | Alloy Compositions (wt. %) | | | | | | |
|---|---|---|---|---|---|---|---|
| Alloy | Cu | Li | Ag | Mg | Zn | Zr | Ti |
| A | 6.18 | 1.35 | 0.41 | 0.40 | 0 | 0.16 | 0 |
| B | 4.52 | 1.29 | 0.40 | 0.36 | 0 | 0.14 | 0.03 |
| C | 4.13 | 1.27 | 0.40 | 0.40 | 0 | 0.14 | 0.02 |
| D | 4.38 | 1.04 | 0.38 | 0.38 | 0 | 0.14 | 0.03 |
| E | 5.70 | 1.29 | 0 | 0.34 | 0 | 0.15 | 0.04 |
| F | 4.01 | 0.84 | 0 | 0.40 | 0 | 0.14 | 0.03 |

TABLE 2-continued

| | Alloy Compositions (wt. %) | | | | | | |
|---|---|---|---|---|---|---|---|
| Alloy | Cu | Li | Ag | Mg | Zn | Zr | Ti |
| G | 6.00 | 1.00 | 0.38 | 0.36 | 0 | 0.14 | 0.04 |
| H | 4.23 | 0.73 | 0.40 | 0.34 | 0 | 0.15 | 0.02 |
| I | 4.28 | 0.85 | 0.36 | 0.40 | 0 | 0.14 | 0.03 |
| J | 3.95 | 1.03 | 0.39 | 0.37 | 0 | 0.14 | 0.03 |
| K | 4.19 | 1.21 | 0.37 | 0.38 | 0 | 0.14 | 0.04 |
| L | 4.00 | 1.41 | 0.38 | 0.37 | 0 | 0.14 | 0.03 |
| M | 3.78 | 1.81 | 0.40 | 0.34 | 0 | 0.15 | 0.03 |
| N | 4.04 | 0.86 | 0.38 | 0.24 | 0 | 0.14 | 0.03 |
| O | 4.28 | 0.84 | 0.36 | 0.38 | 0 | 0.14 | 0.03 |
| P | 4.31 | 0.80 | 0.36 | 0.38 | 0 | 0.14 | 0.03 |
| Q | 4.04 | 0.85 | 0.38 | 0.60 | 0 | 0.15 | 0.03 |
| R | 4.90 | 1.15 | 0.40 | 0.40 | 0 | 0.14 | 0.02 |
| S | 3.58 | 0.93 | 0.35 | 0.34 | 0.22 | 0.15 | 0.04 |
| T | 3.79 | 0.92 | 0.34 | 0.34 | 0.40 | 0.15 | 0.03 |
| U | 4.00 | 1.00 | 0.40 | 0.40 | 0 | 0.14 | 0.02 |
| V | 3.62 | 0.99 | 0.35 | 0.36 | 0 | 0.15 | 0.04 |
| W | 3.61 | 0.91 | 0 | 0.33 | 0.39 | 0.15 | 0.04 |
| X | 2.8 | 0.86 | 0 | 0.38 | 0.65 | 0.14 | 0.02 |
| Y | 3.5 | 0.79 | 0 | 0.41 | 0.75 | 0.14 | 0.02 |
| Z | 2.16 | 0.80 | 0 | 0.38 | 0 | 0.14 | 0.03 |
| AA | 3.18 | 0.78 | 0 | 0.36 | 0 | 0.15 | 0.02 |
| BB | 3.56 | 0.29 | 0 | 0.39 | 0 | 0.14 | 0.03 |
| CC | 3.43 | 0.56 | 0 | 0.35 | 0 | 0.14 | 0.03 |
| DD | 3.41 | 1.12 | 0.38 | 0.36 | 0 | 0.14 | 0.03 |
| EE | 4.47 | 0.95 | 0.43 | 0.43 | 0 | 0.14 | 0.02 |
| FF | 4.99 | 1.23 | 0.38 | 0.46 | 0 | 0.17 | 0.04 |
| GG | 5.20 | 1.00 | 0.40 | 0 | 0 | 0.16 | 0 |

Unless otherwise indicated, each of the above listed compositions was prepared as follows. The alloys were cast as 23 kilogram (50 lb.), 16.5-cm (6.5-inch) diameter ingots using an inert gas induction melting furnace. The ingots were homogenized at 450° C. for 16 hours plus 504° C. for 8 hours, scalped and extruded into 1.9×5.1 cm (¾×2 inch) rectangular bars at a preheat temperature of 370° C. (700° F). The extrusions were solution heat treated for one hour at a temperature just below the solidus and then water quenched. Varying amounts of stretch of from 0–9.5% were applied to the alloys and varying artificial aging temperatures and times were employed.

The term "worked" as used in accordance with the present invention is defined as the introduction of the equivalent of up to about 12 percent stretch to an alloy. In addition to stretching, other means of working can be used such as rolling, roll forming, bump forming, spinning, shot peening and the like. Preferred amounts of stretch, or the equivalent thereof, range from about 3 to about 9 percent, with from about 4.5 to about 7 percent generally being more preferred, depending on the alloy composition, the geometry of the part, and other processing parameters. Working of the alloys is typically carried out at room temperature (cold work), but both cryogenic and warm temperatures may be suitable.

Artificial aging temperatures may vary, with temperatures of less than about 120° C. to greater than about 180° C. being satisfactory for most alloys. Artificial aging temperatures of from about 125° to about 145° or 150° C. are preferred in order to promote the desirable cryogenic fracture toughness trend. Aging times are dependent on aging temperature and may extend up to a point at which the length of time becomes impractical. Aging times of from about 0.25 to about 500 hours may typically be used, with from about 2 to about 48 hours being preferred, and about 4 to about 24 hours being most preferred, depending on the alloy composition and other processing parameters.

The alloys of the present invention are typically cast into ingot form or billet form. The term "ingot" as used herein is broadly defined as a solid mass of alloy material. The term "billet" as used herein includes hot worked, semi-finished products suitable for subsequent working by such methods as rolling, extruding, forging, etc. While the formation of ingots or billets of the present alloys by casting techniques is preferred, the alloys may also be provided in ingot or billet form consolidated from fine powders or particulates. The powder or particulate material can be produced by such processes as atomization, mechanical alloying, melt spinning, splat cooling, plasma deposition and the like.

The alloys of the present invention may be provided in various known wrought forms, including extrusions, sheet, plate, forgings and the like. The term "wrought" alloy as used herein is defined as a product that has been subjected to mechanical working by such processes as extruding, rolling, forging, spin-forming and the like. The term "sheet" is defined in accordance with the present invention as a rolled product having a generally rectangular cross section with a thickness of from about 0.006 to about 0.249 inch, and having sheared, slit or sawed edges. The term "plate" is defined in a similar manner as sheet, with the exception that the thickness is about 0.250 inches or greater.

The following examples illustrate various aspects of the present invention and are not intended to limit the scope of the invention. Unless stated otherwise, all yield strength values are in the longitudinal direction and all toughness values are in the L-T orientation. The term "L-T" means that the loading direction is parallel to the working direction and that the direction of crack propagation is along the longest axis of the product that is perpendicular to the working direction. Most fracture toughness values are plane strain fracture toughness measured from precracked compact tension specimens. Some fractured specimens failed the ASTM B399 plasticity check so the toughness is described as $K_Q$ rather than $K_{Ic}$ (ASTM B399). However, the flat nature of the fractures suggests that the $K_Q$ values are close to $K_{Ic}$ values.

Most cryogenic tanks used for launch systems use aluminum alloys of sufficiently thin gages that service loading conditions are under plane stress. Plane stress fracture toughness is thickness dependent and it is difficult to obtain such toughness values with sufficiently low scatter to discern subtle differences in toughness caused by alloying and processing effects. To circumvent such difficulties, plane strain fracture toughness ($K_{Ic}$) was measured from thicker gages to assess toughness and the cryogenic toughness trend because $K_{Ic}$ is a fundamental materials parameter and is largely unaffected by differences in specimen size. In addition, $K_{Ic}$ values generally display lower scatter than do other measures of toughness.

EXAMPLE 1

An extrusion of Alloy A (6.18 wt % Cu) was solution heat treated at 504° C. for 1 hour, quenched in water (WQ) at 20° C. incubated for 1 hour at 20° C., stretched longitudinally 3% and artificially aged at 160° C. for 6 hours. A longitudinal yield strength (YS) of 94.3 ksi and an ultimate tensile strength (UTS) of 98.5 ksi is achieved, with an elongation of 5% at 20° C. i.e., underaged T8 properties. The 20° C. plane strain fracture toughness ($K_{Ic}$), measured on fatigue precracked compact tension specimens in the L-T orientation is 18.6 ksi√in. At −196° C. the YS and UTS increase to 116 ksi and 123 ksi, respectively. The strength of a given aluminum alloy is expected to increase with decreasing test temperature provided that the alloy does not experience premature brittle fracture, which is a manifestation of low toughness or ductility. Ductility at −196° C. decreases to 2.2% elongation and toughness decreases to 17 ksi√in. This exemplifies the undesirable cryogenic fracture toughness trend.

EXAMPLE 2

Alloy A was aged to a higher strength level than in Example 1, i.e., aged at 160° C. for 24 hours, giving a 20° C. YS of 98.7 ksi, UTS of 101.5 ksi and elongation of 5.4%. Fracture toughness at 20° C. at this higher strength level is quite low at 13.4 ksi√in. This toughness is sufficiently low such that the alloy would not be competitive for toughness-critical applications at this strength level. Consequently, toughness at −196° C. was not measured, but the cryotoughness trend would be expected to be undesirable.

EXAMPLE 3

Alloy B was processed similarly to Alloy A in the preceeding examples. Alloy B has a similar composition to that of Alloy A, except that Cu content is significantly lower at 4.52 wt %. Alloy B's 20° C. underaged T8 properties after a slightly underaged heat treatment (16 h at 160° C.) are higher in strength, at 99.7 YS and 102 UTS, and higher in tensile elongation at 6.4%. Alloy B's 20° C. fracture toughness is also higher at a $K_{Ic}$ of 22.3 ksi√in at this higher strength level. This is significant because the alloy was aged 5 ksi stronger than Alloy A in Example 1, where the toughness at 20° C. was only 18.6 ksi√in. These improvements in room temperature ductility and toughness are believed to result from the decrease in Cu content. At −196° C., YS increases to 122 ksi, UTS increases to 130 ksi and ductility increases to 7.4% elongation. On the other hand, at −196° C. toughness decreases very slightly to 21.4 ksi√in, virtually a flat trend at an extremely high strength level. Thus, decreasing the Cu content from 6.18 to 4.52% comes very close to producing the desirable cryogenic fracture toughness trend with material stretched 3% and aged to a 20° C. YS of about 100 ksi.

EXAMPLE 4

Alloy B was aged for 16 hours at 160° C. as in Example 3, but was stretched 5% instead of 3%. By stretching 5%, aging kinetics are increased such that artificial aging for 16 h at 160° C. now gives peak strength (103 ksi Ys, 105 ksi UTS with 6% el). Fracture toughness at 20° C. is 20.2 ksi√in at this ultra-high strength level. However, toughness increases significantly at −196° C. to 25.0 ksi√in. Thus, the desirable trend is achieved at an extremely high strength level by lowering the Cu to 4.52% and increasing the stretch level to 5%.

EXAMPLE 5

Alloy C is similar to Alloys A and B but has a Cu content of 4.13%. When similarly processed (SHT 511° C. for 1 h, WQ, stretched 3% and aged for 12 h at 160° C.), it is slightly weaker in the T8 temper at 94 ksi YS and 98 ksi UTS, but has better 20° C. fracture toughness than that of the 4.52% Cu Alloy B, i.e., 24.5 instead of 22.3 ksi√in. At −196° C., YS increases to 115 ksi, but fracture toughness decreases to 19.3 ksi√in (see FIG. 1). Thus, although the decrease in Cu to 4.13% increases toughness at 20° C. at the 3% stretch level, the desirable cryogenic fracture toughness trend is not achieved at the 94 ksi YS level.

EXAMPLE 6

Alloy C is underaged to a 20° C. YS of 89 ksi, at which point the onset of the desirable trend is achieved (fracture toughness of 33.9 ksi√in at 20° C. and 34.3 ksi√in at −196° C.). Underaging Alloy C further to 86 ksi YS at 20° C. increases toughness and clearly results in the desirable trend. That is, 20° C. toughness is 38.7 ksi√in, while −196° C. toughness is 40.4 ksi√in (see FIG. 1). This represents an excellent example of the desirable cryogenic fracture toughness trend at both a high strength and a high toughness level.

The effect of lower Cu on the desirable cryogenic fracture toughness trend is shown in the preceeding examples. However, it is noted that the desirable trend can be attained at higher Cu levels with greater stretch, as shown in the following examples.

EXAMPLE 7

Alloy D is similar in composition to alloy B except that the Li content is slightly lower. Part of this extrusion was stretched 3% and part 6%. The desirable trend is just about attained at a 20° C. YS of 88 ksi at the 3% stretch level, but it is reached very easily at the 93 ksi 20° C. YS level with 6% stretch (see Table 3). Furthermore, the desirable trend is almost achieved at 98.5 ksi YS. The desirable trend is more readily achieved because of the higher stretch level and, in addition, the lower Li content which will be further illustrated later.

The greater ease at which the desirable trend can be achieved with decreasing Cu content is also observed in the Al—Cu—Li—Mg system. This can be seen in Examples 8 and 9 below.

EXAMPLE 8

Alloy E is similar in composition to Alloy A except that Alloy E is Ag—free. Alloy E's peak 20° C. strength with 3% stretch can be attained by aging for 16 h at 160° C. (95.2 ksi YS, 98.3 ksi UTS and 6% el). The peak strength of Alloy E is slightly lower than that of Alloy A because of the absence of Ag in Alloy E. At −196° C., strength increases to 114 ksi YS and 123 ksi UTS, with a decrease in elongation to 4.0%. Toughness at 20° C. is 16.9 ksi√in, decreasing slightly to 16.6 ksi√in at −196° C. This toughness can be increased with only a slight strength penalty by underaging, e.g., aging for 6 h at 160° C. producing a YS of 94.2 ksi, UTS of 98.6 ksi, elongation of 7.9% and $K_Q$ of 25.4 ksi√in at 20° C. The properties at −196° C. are 111 ksi YS, 123 ksi UTS, 7.5% el and $K_Q$ of 23.0 ksi√in. The desirable trend is not quite achieved in either case.

EXAMPLE 9

Alloy F is similar in composition to Alloy E, but is significantly lower in Cu and Li content (see Table 2). The decrease in solute produces a lower peak YS at 20° C. of 90 ksi compared to that of Alloy E. In a slightly underaged condition after 6% stretch (aged at 143° C. for 30 h), 20° C. properties are 88.1 ksi YS, 90.8 ksi UTS, 10.5% el and 39.4 ksi√in toughness. At −196° C., YS increases to 104.8 ksi, UTS increases to 111.2 ksi and elongation increases to 11.2%. Importantly, toughness increases to 47.1 ksi√in, an excellent example of the desirable trend. With slightly less aging of Alloy F to a 20° C. YS of 85 ksi, a 20° C. $K_{Ic}$ of 39.7 ksi√in is achieved, while a −196° C. toughness of 51.0 ksi√in is achieved. Thus, the desirable trend is achieved and the teaching in Examples 1–7 for Al—Cu—Li—Ag—Mg alloys applies to Al—Cu—Li—Mg alloys.

EXAMPLE 10

Alloy G is similar in composition to Alloy A (high Cu content) but has a lower Li content of 1.0% (see Table 2). When processed similarly to Alloy A (370° C. preheat temperature for extrusion, 504° C. SHT, WQ, stretch 3% and age for 16 h at 160° C.), similar tensile properties to those of Alloy A are obtained, but with higher toughness. That is, at 25° C. a YS of 103 ksi, UTS of 105 ksi, elongation of 3.8% and $K_{Ic}$ of 18.7 ksi√in are obtained. This toughness is higher than the 13.4 ksi√in attained for Alloy A at the ultra-high strength level (see Example 2). At −196° C., similar properties to those of Alloy A are once again obtained (123 ksi YS, 128 ksi UTS and 3.6% el), but with a slightly higher toughness of 19.2 ksi√in than Alloy G at 25° C. Thus, even with such a high Cu content, a flat or desirable cryogenic fracture toughness trend can be attained by lowering the Li content. The benefits of underaging can also be seen by aging alloy G for 6 h at 160° C. instead of 16 h. Strength at 25° C. is still high at a YS of 87.6 ksi and a UTS of 92.8 ksi, but elongation increases to 8% and toughness increases to 30.0 ksi√in. At −196° C., strength is higher (113 ksi YS, 121 ksi UTS and 6.5% el), but toughness, increases to 32.6 ksi√in, clearly the desirable trend. Thus, underaging trades strength for toughness, but, unexpectedly, the desirable cryogenic toughness trend is more readily achieved. Importantly, the desirable trend can be achieved at relatively high Cu levels.

EXAMPLE 11

Figure 2:
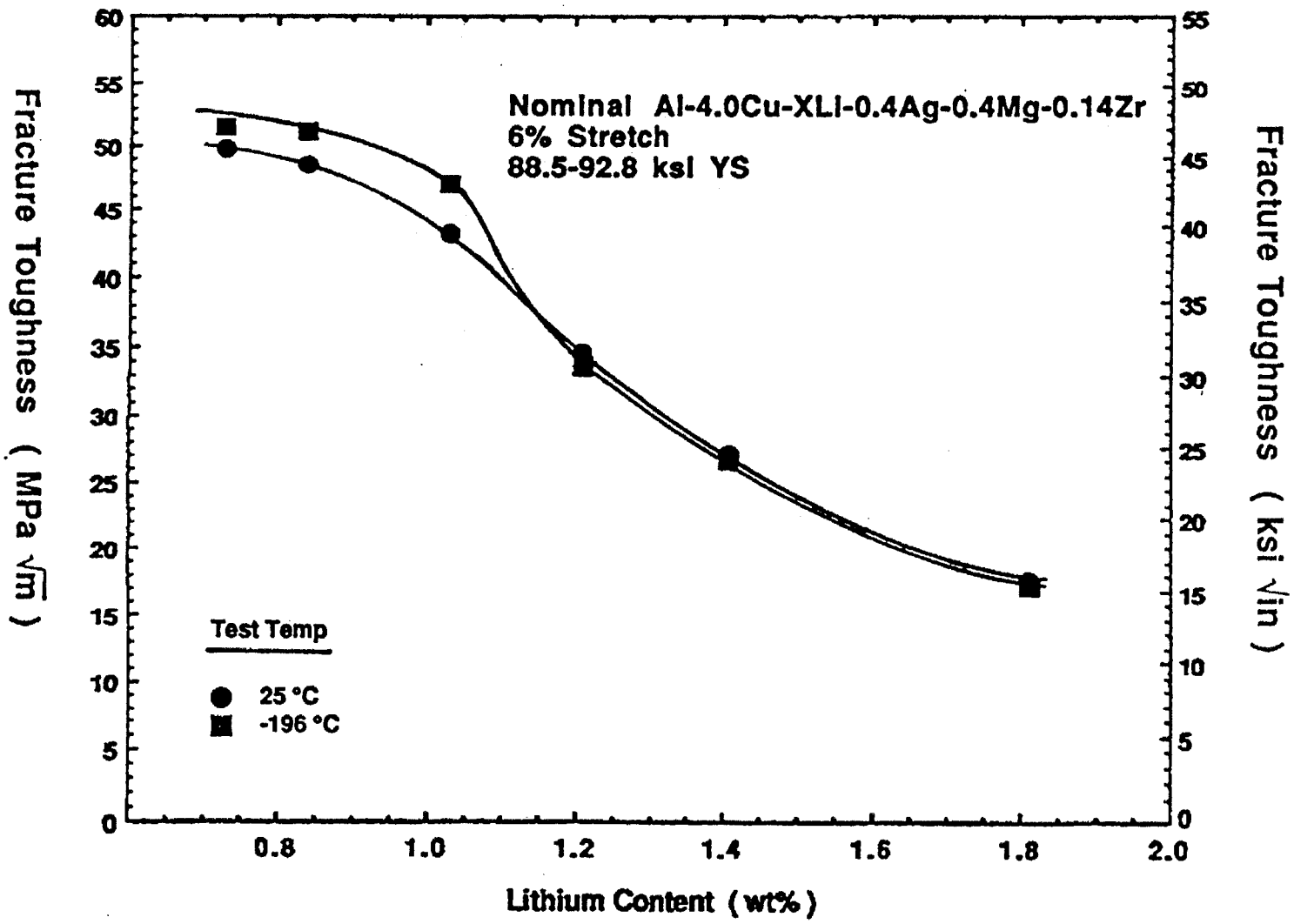
FIG. 2 is a graph of fracture toughness versus lithium content for alloys at room temperature and at cryogenic temperature. The graph shows an increase in cryogenic versus room temperature fracture toughness for alloys having a lower lithium content, but no discernable increase in cryogenic fracture toughness for alloys having a higher lithium content.

This example examines the effect of Li content on the desirable cryogenic toughness trend. In particular, lowering the Li content increases the ease with which the desirable trend is achieved. This can be seen in FIG. 2, in which the compositions of several alloys are very similar except for Li content. The alloys nominally contain Al—4.0Cu—XLi—0.4Ag—0.4 Mg—0.14Zr (see Alloys H–M in Table 2). Each alloy was preheated to 370° C., extruded at a ram speed of 0.25 cm/s (0.1 in/s) in a 16.2-cm (6.375-inch) diameter container to 5.1×1.9 cm bar (2×¾ inch). Each bar was solutionized at 4°–7° C. below its specific solidus temperature, water quenched at 25° C. and stretched 6%. Aging studies at 143° C. were performed for each extrusion and then each was aged at 143° C. to a target room temperature YS of 90 ksi. Actual YS values obtained were similar, with a low of 88.5 ksi and a high of 92.8 ksi. As shown in FIG. 2, toughness at 25° C. and −196° C. each decrease monotonically with increasing Li content. For Li contents of greater than about 1.2%, the toughness trend is approximately flat in each case. However, at Li levels less than about 1.2%, toughness at −196° C. is consistently greater than that at 25° C., i.e., the desirable trend is clearly achieved.

EXAMPLE 12

Figure 3:
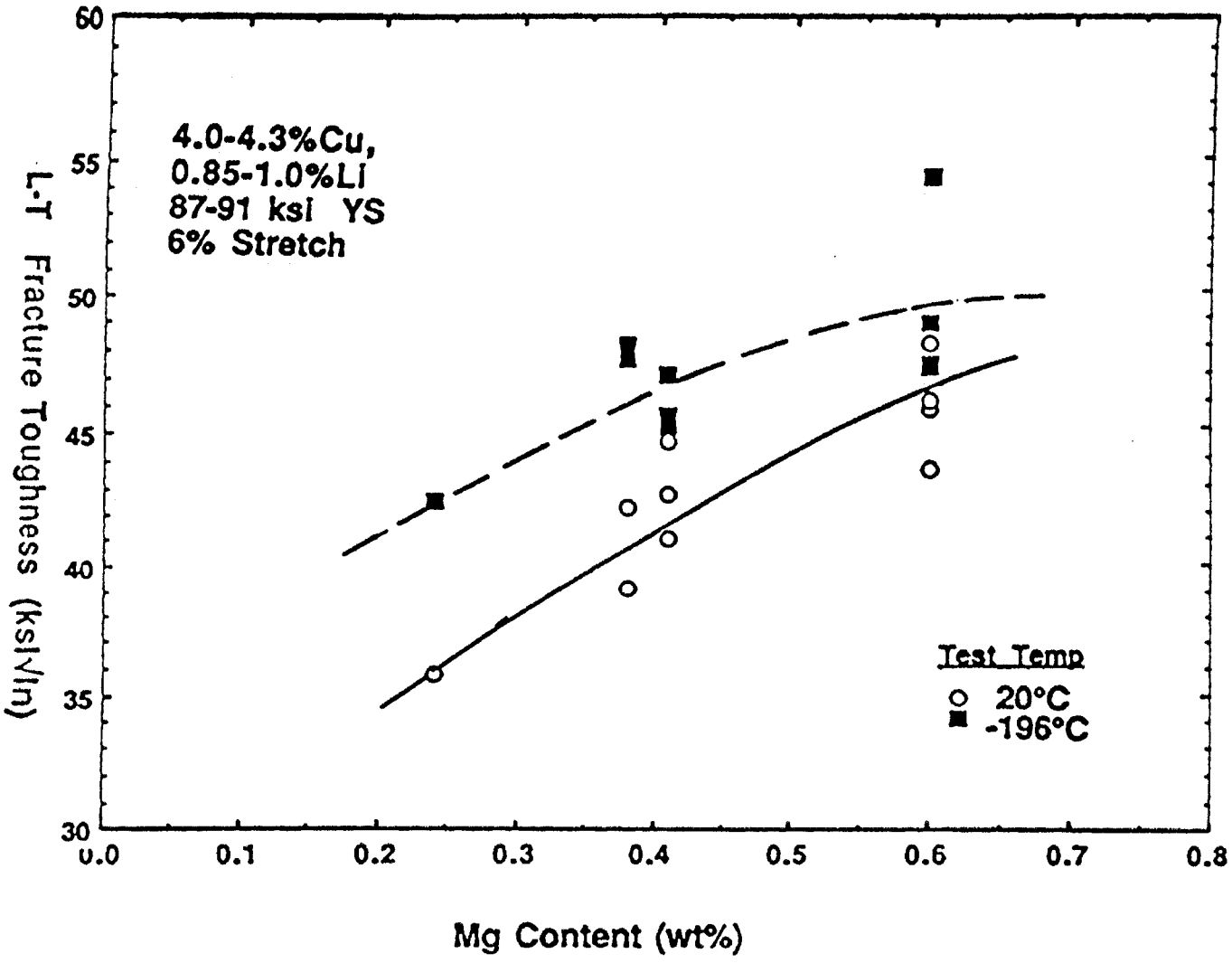
FIG. 3 is a graph of fracture toughness versus magnesium (Mg) content for alloys at room temperature and at cryogenic temperature. The graph shows an increase in cryogenic versus room temperature fracture toughness for all of the alloys.

This example examines the effect of Mg content on the desirable cryogenic toughness trend. Castings of nominal composition Al—4Cu—0.8Li—0.4Ag—XMg—0.14Zr (see Alloys N–Q in Table 2) were prepared under similar conditions. The alloys were preheated at 370° C. and extruded in a 16.2-cm (6.375-inch) diameter container at a ram speed of 0.25 cm/s (0.1 in/s) into 5.1×1.9 cm (2×¾ inch) bar. The heats were solutionized at 3°–6° C. below the individual solidus temperature, i.e., solutionized at 511°–515° C. water quenched at 25° C. and stretched 6%. They were then aged at 143° C. to various YS levels. The properties at the nominal 90 ksi YS level, shown in FIG. 3, indicate that fracture toughness at 20° C. increases with Mg content. Toughness at −196° C. also generally increases with Mg content. The alloys were then tested for fracture toughness at various strength levels at 25 and −196° C. At 25° C. strength-toughness combinations clearly improve with increasing Mg content. At −196° C., strength-toughness combinations improve by raising the Mg content from 0.2 to 0.4 wt %. At 0.6 wt % Mg, the data vary more, but also show higher toughness and the desirable trend. The desirable trend is achieved for each Mg level from 0.2 to 0.6%, but the 0.4 and 0.6% Mg-containing alloys can be aged to higher strengths, i.e., 97–98.1 ksi YS compared to 91 ksi YS for the 0.2% Mg-containing alloy. As can be seen, the toughness values at −196° C. are extremely high for all of these alloys. In addition, underaging also facilitates the ability to attain the desirable cryogenic fracture toughness trend with these alloys of varying Mg content.

EXAMPLE 13

Figure 4:
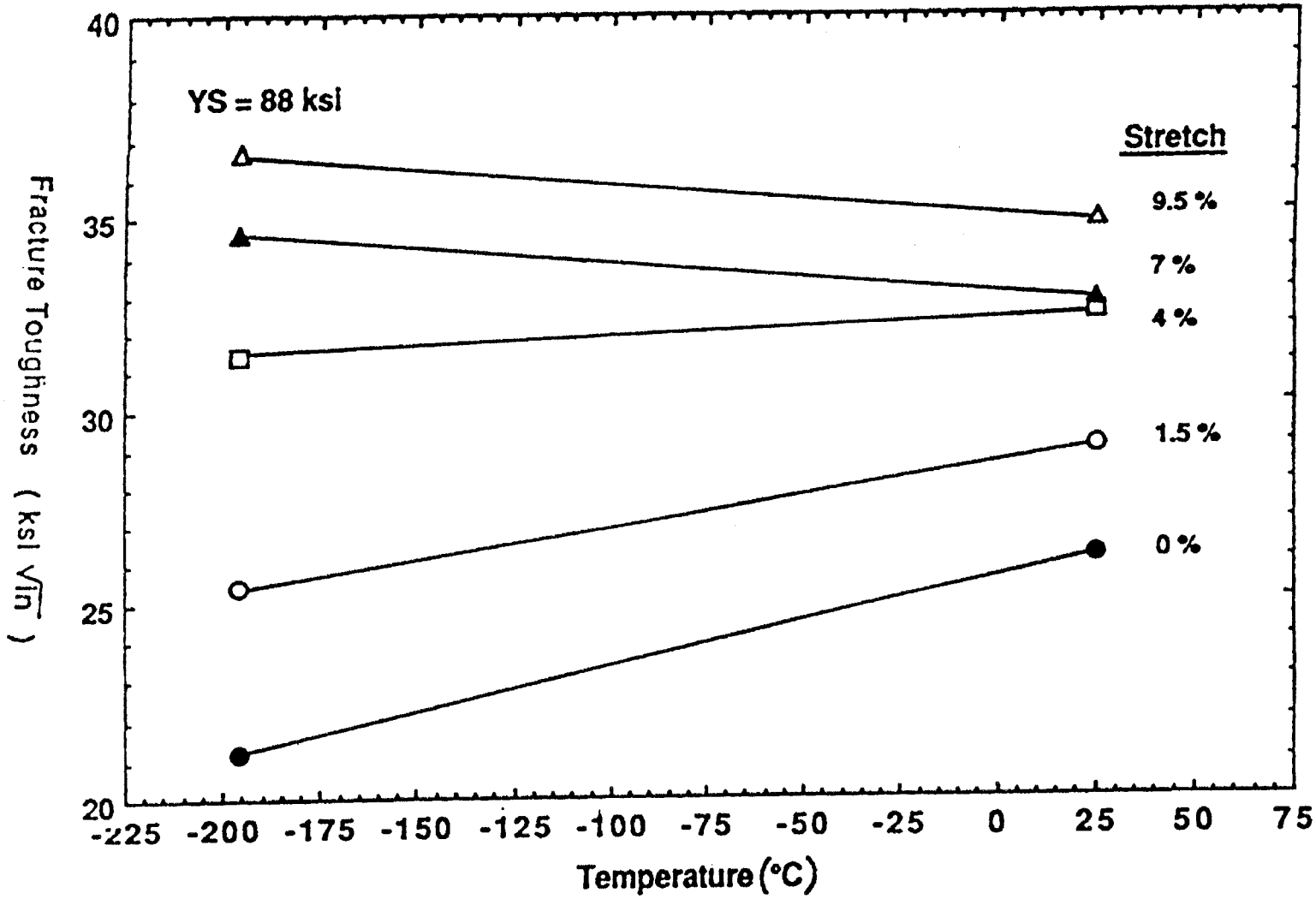
FIG. 4 is a graph of fracture toughness versus temperature for an alloy that has been stretched various amounts. The graph demonstrates a decrease in cryogenic versus room temperature fracture toughness when the alloy is stretched a lesser amount, but an increase in cryogenic fracture toughness when the alloy is stretched a greater amount.

This example examines the effect of cold stretch on the desirable cryogenic fracture toughness trend. Alloy R, having a composition of Al—4.9Cu—1.15Li—0.4Ag—0.4Mg—0.14Zr, was cast and extruded at a preheat temperature of 370° C. (700° F.) in a 16.2-cm (6.375-inch) diameter container at a nominal ram speed of 0.25 cm/s (0.1 in/s) into 5.1×1.9 cm (2×0.75 inch) rectangular bar. The extrusion was solution heat treated at 504° C. for ¾ h, water quenched at 25° C., and a portion of the bar was removed (with 0% stretch). The remaining bar was then stretched 1.5%, a piece was cut off, stretched again with material cut off, and this procedure was repeated giving sections with stretch levels of 0, 1.5, 4, 7 and 9.5%. The artificial aging response was determined for each stretch level and portions of each extrusion were heat treated to a 20° C. YS of 88 ksi. Plane strain fracture toughness from fatigue precracked CT specimens was measured at each stretch level at 20° C. and −196° C. Toughness at 20° C. was found to increase with increasing stretch (see FIG. 4). The undesirable trend was attained at 0, 1.5, and 4% stretch (see FIGS. 4 and 5) at this strength level. However, at the higher stretch levels of 7 and 9.5%, the desirable cryogenic fracture toughness trend is attained. Fractographic and transmission microscopy were performed on each sample. While not intending to be bound by any particular theory, it is believed that stretch refines strengthening precipitation in the grain interiors while decreasing precipitation of coarser precipitates on grain and subgrain boundaries. Such coarse precipitates are known to lower room temperature toughness. However, the surprising result of increased cryogenic toughness, in comparison to room temperature toughness, with increased stretch level is not understood. For Alloy R at the 88 ksi YS stretch level, the cryogenic toughness trend switches from undesirable to desirable at around 4% stretch (see FIG. 5). This switchover point could be moved to lower stretch levels by underaging to lower YS levels, decreasing Cu and/or Li content or, to a lesser extent, decreasing aging temperature.

EXAMPLE 14

The current teachings for attaining the desirable cryogenic toughness trend as shown in Examples 1–13 for Al—Cu—Li—Ag—Mg—Zr and Al—Cu—Li—Mg—Zr alloys also apply to similar alloys containing Zn. Alloy S, which is similar to high toughness Al—Cu—Li—Ag—Mg—Zr Alloy J in that it has relatively low Cu and Li and has been stretched 6%, has about a quarter percent Zn. Zinc has been found to produce beneficial effects on the alloy such as increasing aging response. When the alloy is artificially aged at 143° C. for 20 h, it attains a 25° C. YS of 91.2 ksi, a UTS of 94.2 ksi and an elongation of 12.4%. Just as is the case for Zn-free alloys, strength increases at cryogenic temperatures (YS=112.1 ksi, UTS=118.9 ksi and el=5.2% at −196° C.). Importantly, the high 25° C. toughness of 38.9 ksi√in increases to 43.6 ksi√in at −196° C., an excellent example of the desirable cryogenic toughness trend. Toughness could be increased further by lowering the Cu and/or Li content.

EXAMPLE 15

Alloy T is similar in composition to Alloy S, except that the Zn content is roughly doubled to 0.40%. The alloy was aged for 28 hours at 143° C., which is slightly further along the aging curve than the previous example of Alloy S. Otherwise, the alloy was processed the same. A slightly higher 25° C. YS of 94.0 ksi, UTS of 95.8 ksi and elongation of 9.9% are achieved. At −196° C., YS increases to 114 ksi and UTS increases to 119.8 ksi, with 9.4% elongation. Importantly, the high 25° C. toughness of 35.9 ksi√in is virtually unchanged at 36.1 ksi√in at −196° C., indicating that the threshold of the desirable trend has been reached. The fact that this Zn-containing Al—Cu—Li—Ag—Mg alloy has been aged slightly longer than the previous example of Alloy S, and therefore goes from a very desirable trend to a flat trend, is the same behavior observed in the Al—Cu—Li—Ag—Mg and Al—Cu—Li—Mg alloys. Nevertheless, a desirable or flat trend is attained for each Zn-containing alloy at very high strength levels.

EXAMPLE 16

Figure 6:
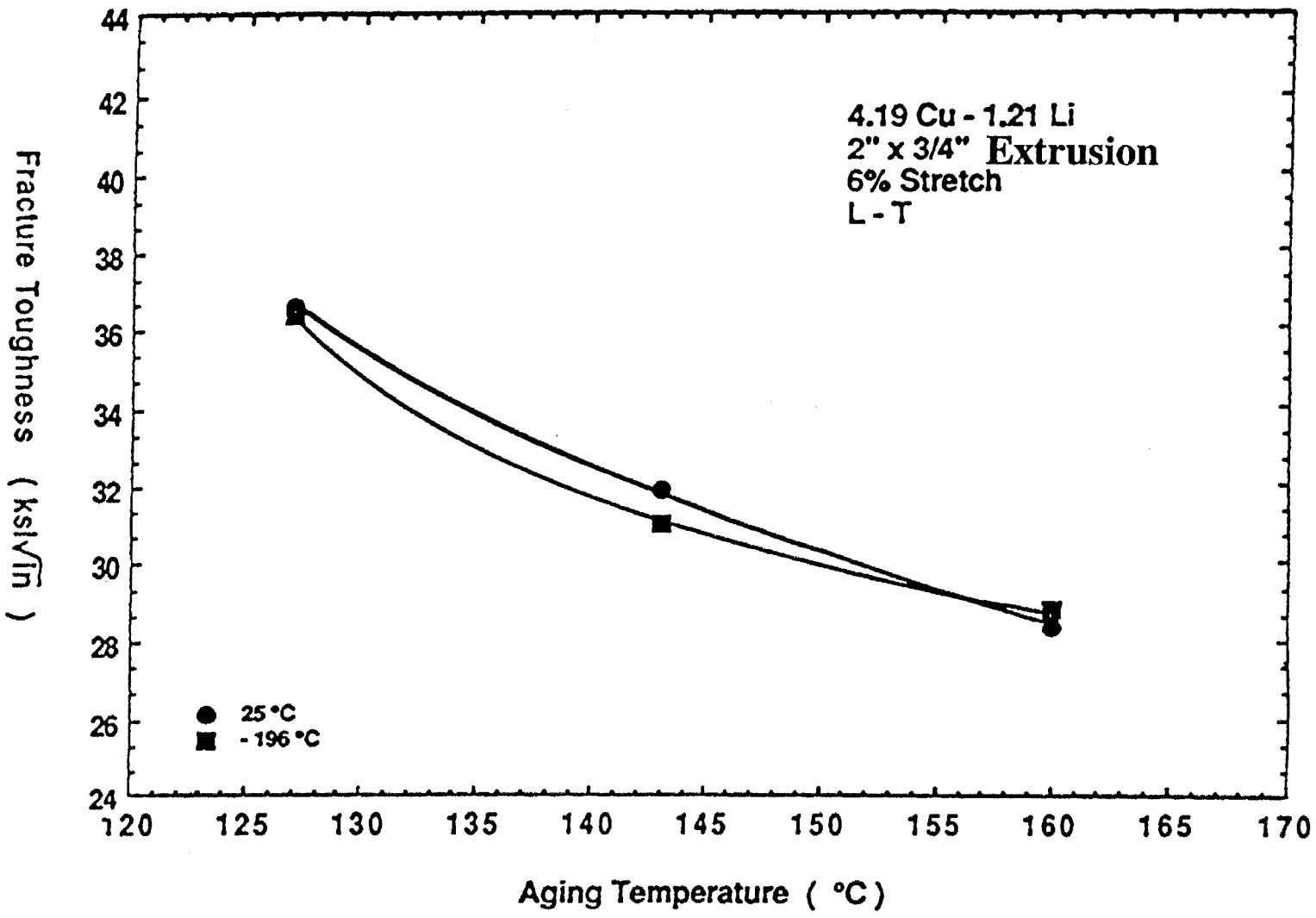
FIG. 6 is a graph of fracture toughness versus aging temperature for an alloy at room temperature and at cryogenic temperature. The graph shows that both room temperature and cryogenic fracture toughness increase as aging temperature decreases.

This example examines the effect of aging temperature on the desirable cryogenic fracture toughness trend. Alloy K having a composition of Al— 4.19Cu—1.21Li—0.37Ag—0.38Mg—0.14Zr—0.04Ti was cast, extruded, solutionized, quenched and stretched 6% as described in Example 11. Samples were then artificially aged at varying temperatures of from 127° to 160° C. to attain a room temperature YS of about 90 ksi. One sample was aged at 127° C. for 100 hours to achieve a room temperature YS of 88.4 ksi, a UTS of 94.7 ksi, an elongation of 8.8% and a $K_Q$ of 36.6 ksi√in. At −196°C., the sample aged at 127° C. attained a YS of 103.4 ksi, a UTS of 113.4 ksi, an elongation of 10.9% and a $K_Q$ of 36.4 ksi√in. Another sample was aged at 143° C. for 22 hours to attain a 25° C. YS of 90.7 ksi, a UTS of 94.9 ksi, an elongation of 10.1% and a $K_Q$ of 31.9 ksi√in. At −196° C., this sample attained a YS of 108.7 ksi, a UTS of 116.0 ksi, an elongation of 9.4% and a $K_Q$ of 31.0 ksi√in. A third sample was aged at 160° C. for 4.5 hours to attain a 25° C. YS of 91.0 ksi, a UTS of 94 4 ksi, an elongation of 7.7% and a $K_Q$ of 28 4 ksi√in. At −196° C., this sample achieved a YS of 108.6 ksi, a UTS of 115.5 ksi, an elongation of 8.7% and a $K_Q$ of 28.8%. As shown in FIG. 6, for each of the above aging temperatures, the cryogenic fracture toughness trend is essentially flat for each aging temperature at this strength level. However, fracture toughness values at both room temperature and cryogenic temperature increase significantly as the aging temperature for the alloy decreases.

EXAMPLE 17

Figure 7:
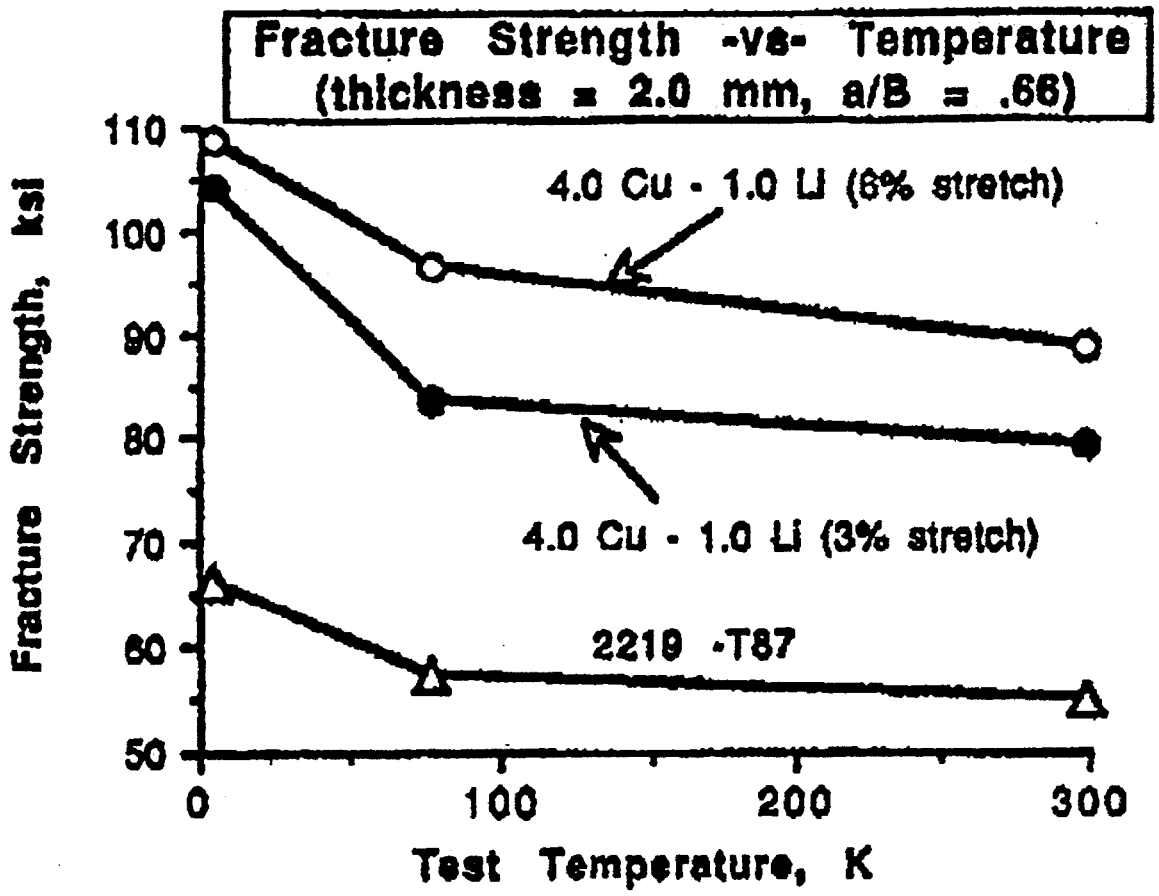
FIG. 7 is a graph of fracture strength versus temperature for an alloy of the present invention that has been stretched varying amounts. In addition, fracture strength versus temperature for a conventional alloy is shown. The graph demonstrates an increased improvement in cryogenic fracture strength when this alloy of the present invention is stretched a greater amount. Furthermore, a significant improvement in both strength and fracture toughness of the present alloy in comparison to the conventional alloy is shown.

Alloy U having a composition of Al—4.0Cu—1.0Li—0.4Ag—0.4Mg—0.14Zr (virtually the same as Alloy J) was cast and rolled to 9.5 mm (0.375 in.) plate, solution heated at 510° C. (950° F.), quenched in water at 20° C. and either stretched 3% or 6%. Plate at each stretch level was aged at 143° C. to a 20° C. YS of 85 ksi. The plates were machined down to 2.0 mm to simulate anticipated flight gages for the External Tank of the Space Shuttle. To evaluate fracture toughness of the alloy at this thickness, the surface crack tension test (ASTM E740) was used. In this test, a central notch is electro-discharge machined and fatigue precracked to a predetermined semielliptical size by fatigue loading. The flaw was controlled so the crack-depth to plate-thickness ratio is 0.66, i.e., the flaw extends about two thirds through the thickness. The panel is then tested to failure in tension and the fracture stress is taken as a measure of toughness in this mostly plane stress specimen. Tests were performed in the T-L orientation to compliment earlier data in the L-T orientation. Panels of conventional alloy 2219-T87 were also tested for comparison. As shown in FIG. 7, both stretch levels display a significant toughness advantage over 2219-T87, the alloy currently used on the Space Shuttle External Tank. For example, the variant with 6% stretch has a 69% advantage over 2219 at a test temperature of 4K, which could translate directly to a structural weight savings in the tank membranes of that gage. It is noted that both stretch levels show the desirable trend for the 2.0 mm gage and that toughness increases with stretch level as was shown in the previous examples for extrusions.

EXAMPLE 18

Alloy V, comprising Al—3.62Cu—0.99Li—0.35Ag—0.36Mg—0.15Zr—0.04Ti, falls within the most preferred compositional range of the present invention. With 6% stretch and artificial aging at 143° C. for 26 hours, the alloy attains room temperature properties of 90.0 ksi YS, 91.5 ksi UTS, 8.7% elongation and 38.7 ksi√in $K_{Ic}$. At −196° C., the alloy attains properties of 114.8 ksi YS, 120.0 ksi UTS, 9.6% elongation and 40.7 ksi√in $K_{Ic}$ (see Table 3), i.e., the desirable cryogenic fracture toughness trend is obtained.

EXAMPLE 19

Alloy W, comprising Al—3.61Cu—0.91Li—0.33Mg—0.39Zn—0.15Zr—0.04Ti, was stretched 6% and artificially aged at 143° C. for varying lengths of time as shown in Table 3. This alloy attains a peak strength of about 90 ksi, which is attained by aging for 26 hours at 143° C. At this aging temperature, strength does not change significantly for longer aging times. For example, increasing the aging time by about 70% to 44 hours only over-ages the alloy very slightly as 25° C. YS decreases to about 89 ksi (See Table 3). However, this increased aging has an adverse effect on the cryogenic fracture toughness trend. As can be seen in Table 3, the desirable cryogenic fracture toughness trend is essentially attained at the shorter aging time but is not attained at the longer aging time.

EXAMPLE 20

Alloys X and Y are Ag-free and contain Zn (see Table 2). As shown in Table 3, the room temperature strengths of these alloys are quite high, especially considering the relatively low alloying content of these alloys. Furthermore, the room temperature plane strain fracture toughnesses are well above 50 ksi√in. The toughnesses of these alloys are so high that valid L-T $K_{Ic}$ toughness values are not obtained with the 2×¾ inch extruded bar samples. Each of Alloys X and Y are capable of attaining the desirable cryogenic fracture toughness trend.

EXAMPLE 21

Alloy Z contains 2.16% Cu (see Table 2). Significantly lower strengths are obtained with this low-copper variant as shown in Table 3. Although the desirable trend can be attained with this alloy, the strengths are less desirable than those for the alloys in aforementioned examples.

EXAMPLE 22

Alloy AA falls within the most preferred compositional range of the present invention (see Table 2). As shown in Table 3, high strengths are obtained at room temperature, especially considering the relatively low alloying content of the alloy. The room temperature plane strain fracture toughness is above 50 ksi√in. However, since the toughness is so high, valid L-T $K_{Ic}$ toughness values are not obtained with the 2×¾ inch extruded bar samples. Alloy AA is readily capable of attaining the desirable cryogenic fracture toughness trend.

EXAMPLE 23

Alloy BB and CC contain 0.29% Li and 0.56% Li, respectively. Otherwise, the alloys are very similar in composition (see Table 2). Alloy BB, containing the lower amount of Li, possesses significantly decreased room temperature strengths compared to Alloy CC, as shown in Table 3. Although each alloy could attain the desirable cryogenic fracture toughness trend, the lower Li content of alloy BB causes the alloy to have much lower strengths than alloy CC, and alloys in aforementioned examples.

From the foregoing examples it can be seen that the desirable cryogenic fracture toughness trend can be achieved in accordance with the present invention by controlling composition, stretch and artificial aging of the alloys. The effects of these parameters are set forth in Table 3.

EXAMPLE 24

Alloy DD is similar in composition to alloy S, except that it is Zn free and has a lower Cu content of 3.41% and a higher Li content of 1 12%. It was processed similarly to the other alloys in the study, but part of the extrusion was stretched 3% and the remainder 6%. The 3% stretch material was aged for 24 hours at 143° C., giving a 25° C. YS of 88.5 ksi and a $K_Q$ of 29.8 ksi√in. (See Table III) At −196° C. YS increased to 108.4 ksi and $K_Q$ increased to 41.6 ksi. The 6% stretch material was aged for 16 hours at 143° C. and achieved virtually the same 88.4 ksi YS and a $K_Q$ value of 28.7 ksi√in at 25° C. At −196° C., YS increased to 107.2 ksi and toughness increased to 42.1 ksi√in for both the 3% and the 6% stretch materials. Thus, the desirable cryogenic fracture toughness trend was achieved in both cases. This example shows that with properly selected composition, similar results can be achieved at different stretch levels. Furthermore, with alloys of the present invention the desirable trend can be achieved at different stretch levels when heat treatment is carefully controlled. Note also that with an alloy of composition according to this teaching, the desirable trend can be attained at higher strength levels (e.g., 95.5 ksi 25° C. YS, see Table III)

EXAMPLE 25

Alloy EE is similar in composition to alloy D, and has the composition Al—4.47Cu—0.95Li—0.43Ag—0.43Mg—0.14 Zr—0.02 Ti. It was processed similarly the alloys in the previous examples and, importantly, it was extruded to 2×0.75 in rectangular bar. The aspect ratio from this extrusion is a rather low 2.67 (i.e., 2÷0.75), so the long transverse properties would be expected to be fairly close to the short transverse properties.

A section of the bar was stretched 3% and aged at 160° C. for 6 hours, providing a 25° C. longitudinal YS of 86.5 ksi and L-T $K_{Ic}$ of 40.7 ksi√in. These increased at −196° C. to 106.2 ksi YS and 49.3 ksi $K_{Ic}$, respectively. In the long transverse orientation, 25° C. YS was 70.5 ksi and T-L (i.e., long transverse toughness) $K_{Ic}$ was 30.8 ksi√in. At −196° C., long transverse $K_{Ic}$ increased to 36.4 ksi√in. Thus, the desirable cryogenic fracture toughness trend is achieved in both longitudinal and transverse orientation.

EXAMPLE 26

An alloy of composition FF (Al—4.99 Cu—1.23 Li—0.38 Ag—0.46 Mg—0.17 Zr—0.04 Ti) was welded by gas tungsten arc welding using filler wire of composition GG (Al—5.20 Cu—1.00 Li—0.40 Ag—0.16 Zr). Plane strain fracture toughness was measured from compact tension specimens orientated with crack propagation parallel and through the fusion zone, or parallel and through the heat affected zone (HAZ). These specimens are orientated in a T-L orientation. In addition, long transverse tensile testing was performed on specimens including both the fusion zone and the HAZ. Tests were performed at 25° C. and −196° C.

Weldment strength increased from 32.7 ksi YS, 51.4 ksi UTS with 6.9% elongation at 25° C. to 42.0 ksi YS, 63.6 ksi UTS, and 6.1% elongation at −196° C. In addition, fusion zone toughness was 19.0 ksi√in at 25° C. increasing to 22.9 ksi√in at 196° C. Moreover, HAZ toughness increased from 18.8 ksi√in at 25° C. to 23.6 ksi√in at −196° C. Thus, the desirable cryogenic toughness trend was attained on weldments.

TABLE 3

Properties For Varying Compositions With Varying Stretch And Artificial Aging

| | | | | | Room temperature | | | | −196° C. | | | |
|---|---|---|---|---|---|---|---|---|---|---|---|---|
| Alloy (wt. %) | Cu (wt. %) | Li (wt. %) | Stretch | Aging (°C. (h)) | YS (ksi) | UTS (ksi) | El. (%) | $K_{IC}$ (ksi√in) | YS (ksi) | UTS (ksi) | El. (%) | $K_{IC}$ (ksi√in) |
| A | 6.18 | 1.35 | 3 | 160 (6) | 94.3 | 98.5 | 5.0 | 18.6 | 116.0 | 123.0 | 2.2 | 17.0 |
| A | 6.18 | 1.35 | 3 | 160 (24) | 98.7 | 101.5 | 5.4 | 13.4 | | | | |
| B | 4.52 | 1.29 | 3 | 160 (16) | 99.7 | 102.0 | 6.4 | 22.3 | 122.0 | 130.0 | 7.4 | 21.4 |
| B | 4.52 | 1.29 | 5 | 160 (16) | 103.0 | 105.0 | 6.0 | 20.2 | | | | 25.0 |
| C | 4.13 | 1.27 | 3 | 160 (12) | 94.0 | 98.0 | 8.5 | 24.5 | 113.0 | 120.5 | 8.1 | 19.3 |
| C | 4.13 | 1.27 | 3 | 160 (5) | 89.0 | 92.0 | 7.7 | 33.9 | 110.0* | 121.0 | 8.5 | 34.3 |
| C | 4.13 | 1.27 | 3 | 143 (16) | 86.0 | 91.1 | 10.3 | 38.7 | 109.3 | 113.2 | 12.4 | 40.4 |
| D | 4.38 | 1.04 | 3 | 143 (18) | 88.0 | 95.2 | 14.1 | 44.7 | 107.0 | 115.6 | 12.7 | 44.2 |
| D | 4.38 | 1.04 | 6 | 143 (11) | 93.0 | 96.2 | 10.8 | 34.4 | 112.0 | 118.0 | 12.2 | 40.7 |
| D | 4.38 | 1.04 | 6 | 143 (16) | 98.5 | 99.0 | 9.0 | 35.0 | 112.0 | 118.0 | 12.2 | 34.2 |
| E | 5.70 | 1.29 | 3 | 160 (16) | 95.2 | 98.3 | 6.0 | 16.9 | 114.0 | 123.0 | 4.0 | 16.6 |
| E | 5.70 | 1.29 | 3 | 160 (6) | 94.2 | 98.6 | 7.9 | 25.4 | 111.0 | 123.0 | 7.5 | 23.0 |
| F | 4.01 | 0.84 | 6 | 143 (30) | 88.1 | 90.8 | 10.5 | 39.4 | 104.8 | 111.2 | 11.2 | 47.1 |
| F | 4.01 | 0.84 | 6 | 143 (24) | 85.0 | 88.2 | 13.0 | 39.7 | | | | 51.0 |
| G | 6.00 | 1.00 | 3 | 160 (16) | 103.0 | 105.0 | 3.8 | 18.7 | 123.0 | 128.0 | 3.6 | 19.2 |
| G | 6.00 | 1.00 | 3 | 160 (6) | 87.6 | 92.8 | 8.0 | 30.0 | 113.0 | 121.0 | 6.5 | 32.6 |
| H | 4.23 | 0.73 | 6 | 143 (35) | 88.9 | 91.2 | 9.6 | 45.7 | 106.1 | 113.4 | 11.1 | 47.4 |
| I | 4.28 | 0.85 | 6 | 143 (14) | 88.4 | 92.4 | 11.2 | 42.8 | 108.3 | 115.3 | 11.5 | 45.4 |
| J | 3.95 | 1.03 | 6 | 143 (13) | 88.9 | 92.0 | 10.5 | 40.8 | 104.5 | 112.0 | 9.2 | 43.1 |
| K | 4.19 | 1.21 | 6 | 143 (12) | 81.1 | 89.2 | 11.2 | 41.2 | 99.7 | 110.0 | 11.8 | 40.0 |
| K | 4.19 | 1.21 | 6 | 127 (100) | 88.4 | 94.7 | 8.8 | 36.6 | 103.4 | 113.4 | 10.9 | 36.4 |
| K | 4.19 | 1.21 | 6 | 143 (22) | 90.7 | 94.9 | 10.1 | 31.9 | 108.7 | 116.0 | 9.4 | 31.0 |
| K | 4.19 | 1.21 | 6 | 160 (4.5) | 91.0 | 94.4 | 7.8 | 28.4 | 108.6 | 115.5 | 8.7 | 28.8 |
| L | 4.00 | 1.41 | 6 | 143 (16) | 88.5 | 91.1 | 5.6 | 24.8 | 106.2 | 112.0 | 8.5 | 24.3 |
| M | 3.78 | 1.81 | 6 | 143 (24) | 91.4 | 93.0 | 6.2 | 16.0 | 111.0 | 115.1 | 3.9 | 15.7 |
| N | 4.04 | 0.86 | 6 | 143 (14) | 81.5 | 88.0 | 10.3 | | | | | |
| N | 4.04 | 0.86 | 6 | 143 (20) | 85.5 | 89.9 | 10.3 | 36.9 | 103.5 | 111.8 | 11.7 | 46.9 |
| N | 4.04 | 0.86 | 6 | 143 (22) | 90.0 | 92.8 | 9.5 | 35.8 | 105.3 | 112.6 | 9.9 | 42.5 |
| O | 4.28 | 0.84 | 6 | 143 (14) | 87.8 | 92.2 | 12.0 | 44.6 | 96.8 | 111.0 | 13.2 | 47.0 |
| O | 4.28 | 0.84 | 6 | 143 (24) | 94.9 | 96.8 | 10.2 | 33.2 | 115.0 | 121.2 | 8.9 | 37.1 |
| P | 4.31 | 0.80 | 6 | 143 (14) | 89.6 | 93.9 | 11.6 | 42.2 | 105.0 | 113.0 | 12.2 | 47.5 |
| P | 4.31 | 0.80 | 6 | 143 (18) | 91.2 | 94.5 | 11.3 | 39.1 | 111.5 | 117.0 | 9.4 | 47.6 |
| Q | 4.04 | 0.85 | 6 | 143 (20) | 86.0 | 90.5 | 10.7 | 45.7 | 110.0 | 118.1 | 10.5 | 47.3 |
| Q | 4.04 | 0.85 | 6 | 143 (24) | 90.8 | 93.2 | 9.1 | 43.6 | 111.0 | 117.8 | 11.2 | 48.0 |
| Q | 4.04 | 0.85 | 6 | 143 (34) | 93.8 | 95.0 | 9.6 | 39.2 | 113.5 | 118.5 | 8.7 | 39.3 |
| R | 4.90 | 1.15 | 0 | 170 (15) | 87.0 | 93.9 | 6.8 | 26.1 | 105.0 | 112.5 | 4.1 | 21.1 |
| R | 4.90 | 1.15 | 1.5 | 160 (10) | 88.1 | 95.5 | 9.4 | 28.9 | 106.0 | 115.1 | 8.3 | 25.4 |
| R | 4.90 | 1.15 | 4 | 160 (13) | 89.2 | 95.3 | 11.1 | 33.2 | 114.5 | 120.0 | 10.8 | 32.7 |
| R | 4.90 | 1.15 | 7 | 143 (9) | 88.2 | 94.0 | 12.0 | 32.7 | 106.2 | 114.8 | 12.7 | 34.6 |
| R | 4.90 | 1.15 | 9.5 | 143 (9) | 88.1 | 94.2 | 10.9 | 34.8 | 113.0 | 118.5 | 8.5 | 36.7 |
| S | 3.58 | 0.93 | 6 | 143 (20) | 91.2 | 94.2 | 12.4 | 38.9 | 112.1 | 118.9 | 5.2 | 43.6 |
| T | 3.79 | 0.92 | 6 | 143 (28) | 94.0 | 95.8 | 9.9 | 35.9 | 114.0 | 119.8 | 9.4 | 36.1 |
| V | 3.62 | 0.99 | 6 | 143 (26) | 90.0 | 91.5 | 8.7 | 38.7 | 114.8 | 120.0 | 9.6 | 40.7 |
| W | 3.61 | 0.91 | 6 | 143 (28) | 90.5 | 92.5 | 9.8 | 38.5 | 108.0 | 115.2 | 11.3 | 38.2 |
| W | 3.61 | 0.91 | 6 | 143 (44) | 89.0 | 90.1 | 7.8 | 36.4 | 112.8 | 118.5 | 10.9 | 31.8 |
| X | 2.8 | 0.86 | 6 | 143 (12) | 55.9 | 68.8 | 18.9 | | | | | |
| X | 2.8 | 0.86 | 6 | 143 (30) | 74.3 | 78.3 | 12.3 | | | | | |
| X | 2.8 | 0.86 | 6 | 143 (60) | 78.6 | 81.7 | 11.8 | | | | | |
| X | 2.8 | 0.86 | 6 | 143 (90) | 82.2 | 84.9 | 12.0 | 50.0 | | | | |
| Y | 3.5 | 0.79 | 6 | 143 (12) | 71.2 | 79.0 | 14.3 | | | | | |
| Y | 3.5 | 0.79 | 6 | 143 (30) | 84.3 | 88.0 | 13.3 | | | | | |
| Y | 3.5 | 0.79 | 6 | 143 (60) | 86.3 | 88.9 | 12.3 | 50.0 | | | | |
| Y | 3.5 | 0.79 | 6 | 143 (75) | 87.3 | 89.9 | 11.2 | | | | | |
| Y | 3.5 | 0.79 | 6 | 143 (90) | 88.7 | 90.0 | 11.1 | | | | | |

TABLE 3-continued

| Properties For Varying Compositions With Varying Stretch And Artificial Aging | | | | | | | | | | | | |
|---|---|---|---|---|---|---|---|---|---|---|---|---|
| | | | | | Room temperature | | | | −196° C. | | | |
| Alloy (wt. %) | Cu (wt. %) | Li (wt. %) | Stretch | Aging (°C. (h)) | YS (ksi) | UTS (ksi) | El. (%) | $K_{IC}$ (ksi√in) | YS (ksi) | UTS (ksi) | El. (%) | $K_{IC}$ (ksi√in) |
| Z | 2.16 | 0.80 | 6 | 143 (30) | 47.2 | 60.0 | 21.2 | | | | | |
| Z | 2.16 | 0.80 | 6 | 143 (100) | 64.9 | 69.0 | 13.8 | | | | | |
| AA | 3.18 | 0.78 | 6 | 143 (60) | 63.0 | 70.8 | 17.2 | | | | | |
| AA | 3.18 | 0.78 | 6 | 143 (90) | 78.3 | 81.1 | 13.0 | | | | | |
| AA | 3.18 | 0.78 | 6 | 143 (100) | 78.5 | 81.2 | 12.8 | 50.0 | | | | |
| BB | 3.56 | 0.29 | 6 | 143 (60) | 63.0 | 70.8 | 17.2 | | | | | |
| BB | 3.56 | 0.29 | 6 | 143 (100) | 67.5 | 72.0 | 14.2 | | | | | |
| CC | 3.43 | 0.56 | 6 | 143 (60) | 70.6 | 77.0 | 12.8 | | | | | |
| CC | 3.43 | 0.56 | 6 | 143 (90) | 76.0 | 79.3 | 12.8 | | | | | |
| CC | 3.43 | 0.56 | 6 | 143 (100) | 76.7 | 80.0 | 11.5 | | | | | |
| DD | 3.41 | 1.12 | 3 | 143 (24) | 88.5 | 91.8 | 7.9 | 29.8 | 108.4 | 116.0 | 10.9 | 42.0 |
| DD | 3.41 | 1.12 | 6 | 143 (16) | 88.4 | 90.8 | 8.9 | 28.7 | 107.2 | 114.5 | 11.3 | 42.1 |
| DD | 3.41 | 1.12 | 6 | 143 (60) | 95.5 | 96.8 | 6.4 | 25.2 | 116.2 | 121.5 | 9.0 | 33.0 |
| EE (long) | 4.47 | 0.95 | 3 | 160 (6) | 86.5 | 90.9 | 10.4 | 40.7 | 106.2 | 114.5 | 11.2 | 49.3 |
| EE (LT) | 4.47 | 0.95 | 3 | 160 (6) | 70.5 | 78.0 | 8.4 | 30.8 | 74.2 | 95.5 | 10.5 | 36.4 |

*estimated from other data

COMPOSITION

In accordance with the present invention, the desirable cryogenic fracture toughness trend can be achieved by controlling Cu and Li levels. Copper levels of from about 3.0 to about 4.5% and lithium levels of from about 0.7 to about 1.1% are most preferred in order to most readily attain the desirable trend at high strength levels. However, the desirable trend can be achieved for copper levels of from about 2.0 to about 6.5% and lithium levels of from about 0.2 to about 2.7%. In order to produce the desirable cryogenic fracture toughness trend while at the same time producing high levels of strength, Cu levels of 2.8 to 4.8% and Li levels of 0.4 to 1.5% are more preferred. Within these compositional ranges, the combined cryogenic fracture toughness and strength properties are maximized, making such alloys highly superior for cryogenic use. One particularly preferred alloy for cryogenic use comprises 4.0% Cu and 1.0% Li, while another highly preferred alloy comprises 4.5% Cu and 0.8% Li. The amounts of Cu and Li employed are interdependent. For example, for copper levels at the high end of the broad range, e.g., 6.5%, the level of lithium should be close to about 1.0% to achieve the desirable cryogenic fracture toughness trend at high strength levels. At the lower end of the broad Cu range, e.g., 2.0%, more Li can be present but the highest strength attainable will generally be lower, as shown by Alloy Z (see Table 3). Conversely, when the level of lithium is at the low end of the broad range, e.g., 0.2%, the level of copper can be relatively high and the desirable trend can be achieved, but strength will be lower than at higher Li levels of about 1% shown by Alloy BB (see Table 3). At the high end of the broad Li range, e g , 2.7% lower Cu levels such as 2% are preferred in order to attain the desirable trend.

Copper and lithium levels have a significant effect on the strength levels attained in the present alloys. Copper levels above about 4% produce the highest strengths, with significant decreases in strength below about 3% (see Alloy Z in Table 3). In addition, the highest strengths are attained with Li levels of from about 1.05 to about 1.35%, with a peak at about 1.2% lithium. Significant decreases in strength result below about 0.5% and above about 1.5% Li (see Alloy BB in comparison to Alloy CC in Table 3). Thus, while the desirable cryogenic fracture toughness trend is most easily attained and strength levels are very high at copper levels of about 4% and lithium levels of about 1%, lowering of the copper and lithium levels significantly below these amounts may still result in the desirable trend, but with lower strengths. The alloys of the present invention comprising from about 2.8 to about 4.8 percent Cu and from about 0.4 to about 1.5 percent Li have been found to possess superior combinations of both cryogenic fracture toughness and strength properties, thus providing for surprisingly increased performance when used at cryogenic temperatures. The high toughnesses are obtained without the delamination associated with alloys such as 2090, which has inflated toughness values due to an effect known as "delamination toughening". Consequently, alloys such as 2090 actually display lower fracture strength than 2219 in actual tank gages.

The amount of copper and lithium used also affects the processing that must be employed to achieve the desired trend. For example, at the most preferred levels of about 4.0% copper and 1.0% lithium, little or no stretch may be required to achieve the desired trend at high strength levels. However, as the boundaries of the copper and lithium ranges are reached, optimal amounts of stretch and carefully controlled artificial aging treatments may be required in order to produce the desired cryogenic fracture toughness trend at technologically useful strength levels.

The amount of magnesium used in the present alloys has only a minor effect on the cryogenic fracture toughness trend. However, the strength of the alloys is highly dependent on Mg content, with peak strengths being attained at Mg levels of from about 0.3 to about 0.6 percent. Furthermore, increasing the Mg content to levels of about 0.6 to about 1.0% increases the absolute toughness values at the preferred Cu and Li levels.

The presence or absence of silver in the alloys of the present invention does not significantly affect the cryogenic fracture toughness trend. However, Ag produces an improvement in strength.

While the amount of zinc used in the alloys does not appear to have a significant effect on the cryogenic fracture toughness trend, strength levels and aging kinetics (the rate at which the alloys progress along the aging curve) may be increased with the addition of minor amounts of Zn (see Alloys S, T, W, X and Y in Table 3). Thus, additions of Zn and/or Ag do not adversely affect the ability to attain the desirable toughness trend, but their presence may be advantageous for improving other properties such as strength.

STRETCH

Figure 5:
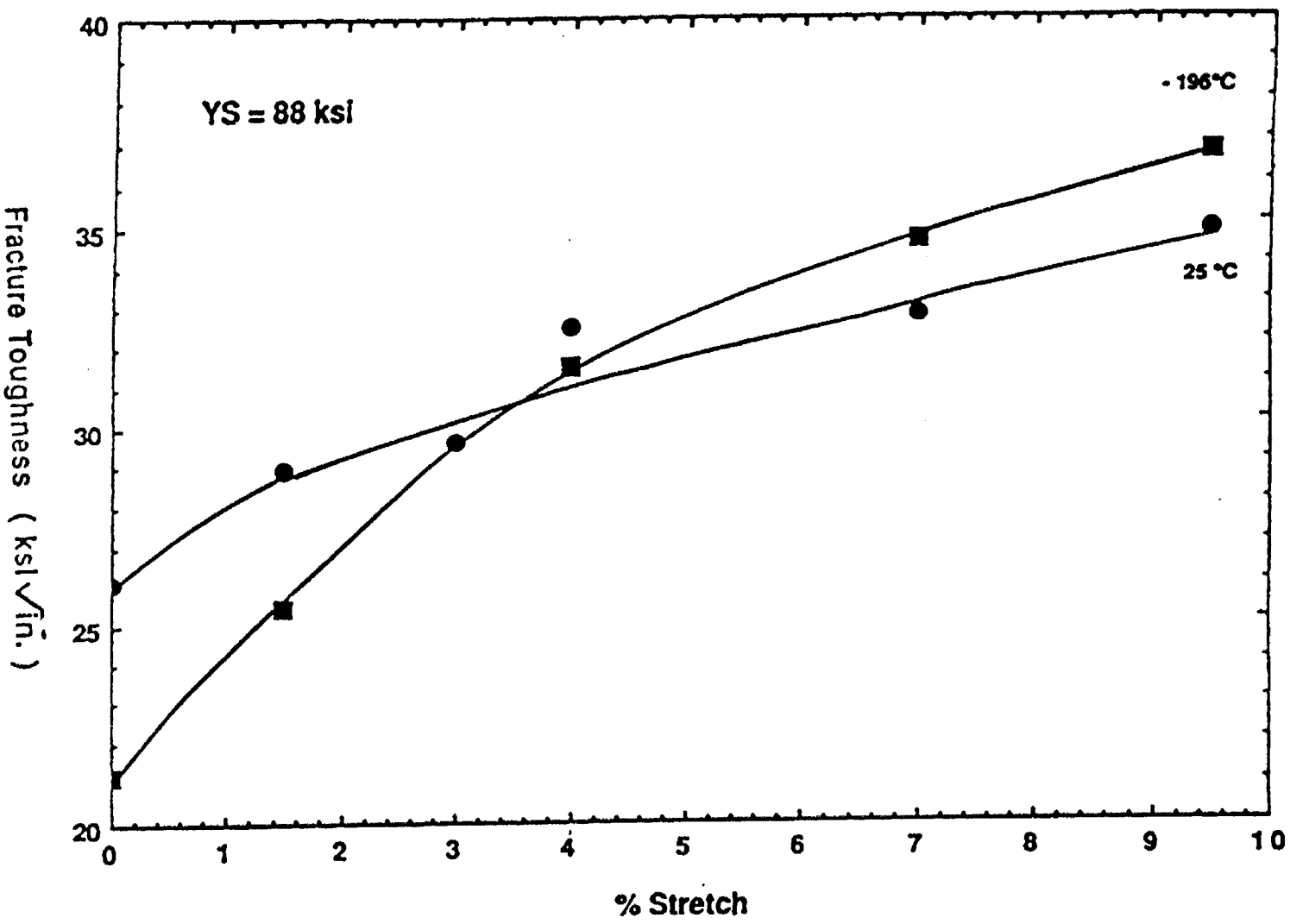
FIG. 5 is a graph of fracture toughness versus percentage of stretch for an alloy at room temperature and at cryogenic temperature. The graph shows a decrease in cryogenic versus room temperature fracture toughness at lower stretch levels, but an increase in cryogenic fracture toughness at higher stretch levels.

The amount of stretch employed in accordance with the present invention has a significant effect on cryogenic fracture toughness and the ability to attain the desirable trend. In general, greater amounts of stretch result in an improved cryogenic fracture toughness trend. For a given Al—Cu—Li alloy, a crossover point may be demonstrated, wherein the desirable trend is achieved above a certain stretch level but is not achieved below that level. FIG. 5 shows one such crossover point. In the alloy illustrated in FIG. 5, the crossover occurs at between 4 and 5% stretch at the 90 ksi strength level. However, this point may change as composition and processing variables are altered. For compositions near the 4.0 Cu and 1.0 Li levels, the amount of stretch may not be as critical. However, near the upper boundaries of the broad Cu and Li ranges as shown in Table 1, the provision of a significant amount of stretch may be necessary in order to attain the desirable cryogenic fracture toughness trend. The amount of stretch employed is also dependent upon the degree of artificial aging used, as more fully described below.

ARTIFICIAL AGING

In accordance with the present invention, artificial aging has a significant effect on the cryogenic fracture toughness trend. In general, underaging tends to produce the desirable trend in comparison to peak or over aging. By aging to a point below peak strength, the desirable trend is more readily attained. For example, while a given alloy of the present invention may be capable of attaining a peak yield strength of 100 ksi, underaging to a yield strength of 90 ksi is more likely to produce the desired cryogenic fracture toughness trend. This phenomena is not fully understood, but a possible explanation may involve the transition from intersubgranular to microvoid fracture. The degree of underaging required is dependent upon alloy composition and processing history. For example, at a preferred copper level of 4% and lithium level of 1%, or 4.5% copper and 0.8% lithium, for a technologically wide range of stretch levels, underaging may not be required and the desirable trend can be achieved at peak strength. However, near the upper copper and lithium boundaries, significant underaging may be required in order to produce the desired trend. A typical underaging treatment is to artificially age the alloy to a yield strength that is at least about 5 ksi below the peak yield strength of the alloy. Such underaging has been found to significantly promote the desirable cryogenic fracture toughness trend. To attain the desirable trend with greater safety margin in a production environment, it may be preferable to age to a yield strength that is about 10 to 20 ksi below the peak yield strength. It is significant that the alloys of the present invention can attain such high peak strengths because technologically useful strengths can still be achieved with significant underaging.

RECRYSTALLIZATION

For wrought Al—Cu—Li alloys in plate, sheet, extrusion, forging and other forms, the cryogenic fracture toughness trend can be significantly affected by the amount of recrystallization. In general, unrecrystallized plate tends to promote the desired cryogenic toughness trend while recrystallized plate tends to decrease the ease with which the desired trend can be attained after solution heat treatment, stretching and aging. Furthermore, the unrecrystallized microstructure is desirable for increased fracture toughness at a given temperature. It may therefore be desirable to, for example, roll the alloy at higher temperatures at which recrystallization is less likely to occur than at lower temperatures at which recrystallization may be induced. For products with higher amounts of recrystallization, a greater degree of underaging and/or a greater amount of stretch is generally necessary to attain the desirable cryogenic toughness trend. Furthermore, lowering the amount of Cu and/or Li may enable greater amounts of recrystallization to be tolerated while still achieving the desirable trend after subsequent solution heat treatment, quenching, stretching and artificial aging.

FABRICATION OF CRYOGENIC CONTAINER

Alloys of the present invention may be rolled, extruded and forged to the product forms necessary to fabricate a container for holding cryogenic materials. Such a cryogenic tank, when used for holding cryogenic liquids such as liquid hydrogen, oxygen or nitrogen, generally consists of the barrel, which is a hollow cylinder, the domes, which are approximately hemispherical in shape, and the rings, which connect the barrel to the fore and aft domes. The barrel may be fabricated from plate that has been processed in accordance with the present invention and which is subsequently machined so that it has longitudinal T-shaped or L-shaped stiffeners. Alternatively, the barrel may be fabricated from integrally-stiffened extrusions which have the T-shaped or L-shaped longitudinal stiffeners introduced during the extrusion event. Furthermore, simple stiffeners may be rolled into the plate, e.g., linear stiffeners. The ring can be formed from extrusions that are bent over a curved tool and welded into a ring, or roll-ring forged, an operation in which a billet is pierced to a doughnut shape and the wall thickness is worked to thinner gages as the diameter increases. The domes may be formed from gore panels of plate or sheet that are stretched over a tool and welded together. Alternatively, the dome can be spin-formed from plate at cold, warm, or hot working temperatures.

In each of these components of the cryogenic tank, the amount of stretch necessary to produce the desirable cryogenic toughness trend can be introduced during the forming operation after solution heat treatment and quench. For example, the plate and extrusion can be simply stretch straightened. Alternatively, cold work can be introduced when the gore panels are stretched over a mandrel, the barrel panels are bump formed over a tool, the ring extrusions are bent and stretched over a tool to introduce curvature, or the dome is spun formed. The artificial aging conditions are selected as previously disclosed to ensure that the desirable trend is achieved.

The tank components may be welded together by virtually any of the conventional welding techniques, including gas tungsten arc welding, dual torch gas tungsten arc welding, metal inert gas welding, variable polarity plasma arc welding, variable polarity gas tungsten arc welding, electron beam welding and others. Conventional filler alloys such as 2319 are acceptable, as are parent filler alloys of the present invention. In addition, parent alloys containing greater amounts of grain refiners, e.g., Zr and Ti, and slightly greater Cu content are often preferred to increase weldment strength.

In fabricating the cryogenic tank or container, the barrel panels are welded together forming a right circular cylinder which is then welded to the ring. The two domes are each welded to a ring, thereby forming the cryogenic tank. It is noted that the cryogenic tank typically also has secondary hardware that may be fabricated by forging to asymmetric shapes, i.e., that cannot be stretched. These components should contain the more preferred amounts of Cu and Li, e.g., 2.8–4.8 Cu and 0.7–1.1 Li, to enable the desirable trend to be attained with no stretch, while still maintaining high strength levels. For some forgings, cold work could be practically introduced by shot peening.

The components of the cryogenic tank can be welded by various parameters depending upon the technique selected. A preferred route is to weld the components using conventional gas tungsten arc welding with conventional 2319 filler. The surfaces to be welded should preferably be mechanically milled or chemically milled in a 100 g/l NaOH aqueous solution such that about 0.5 mm of the surface is removed. A 75% Ar/25% He inert gas cover at 14 /min can be used. For 1 mm diameter 2319 filler, a travel speed of 25 cm/min at a current of 170 Amps and a voltage of 12.5 volts produces high integrity weldments. If the weight of the tank needs to be decreased, conventional chemical milling could be used to reduce the thickness of the barrel in low service load areas. A typical solution for such milling is 103 g/l NaOH, 22 g/l sodium sulphide and 2.2 g/l sodium gluconate to make 1 liter of solution.

Weldments made as described above also display increasing weldment toughness and strength with decreasing temperature. The tank so fabricated can be cost effectively proof tested at room temperature. Because toughness and strength are each substantially the same or greater at cryogenic service temperatures than at the ambient proof test temperature, the tank can be safely used with minimal risk of toughness-limited or strength-overload-induced failures.

It is to be understood that the above description of the present invention is susceptible to various modifications, changes and adaptations by those skilled in the art and that such modifications, changes and adaptations are to be considered to be within the spirit and scope of the invention as set forth by the claims which follow.

What is claimed is:

1. A method for producing an improved aluminum-base alloy comprising the steps of:

a) providing a solution heat treated and quenched aluminum-base alloy consisting essentially of from 2.0 to 6.5 weight percent Cu, from 0.2 to 2.0 weight percent Li, and the balance aluminum and incidental impurities; and b) at least one of working and artificially aging said alloy in an amount sufficient to provide strength and fracture toughness to said alloy at cryogenic temperature substantially equal to or greater than the strength and fracture toughness at room temperature, wherein the fracture toughness at room temperature is at least 18.7 ksi√in and the fracture toughness at −196° C. is at least 19.2 ksi√in.

2. A method according to claim 1, wherein said aluminum-base alloy further contains Mg in an amount up to 40. weight percent and from 0.01 to 1.0 weight percent of at least one grain refiner selected from the group consisting of Zr, Ti, Cr, Mn, Hf, Nb, B, V, and $TiB_2$.

3. A method according to claim 1, wherein said aluminum-base alloy further contains at least one of Ag in an amount up to 4.0 weight percent, Mg in an amount up to 4.0 weight percent, and Zn in an amount up to 3.0 weight percent.

4. A method according to claim 2, wherein said aluminum-base alloy further contains at least one of Ag in an amount up to 4.0 weight percent, Mg in an amount up to 4.0 weight percent, and Zn in an amount up to 3.0 weight percent.

5. A method according to claim 1, wherein said working of said alloy is performed substantially at room temperature.

6. A method according to claim 1, wherein said working of said alloy is achieved by introducing the equivalent of from 3 to 7 percent stretch to said alloy.

7. A method according to claim 1, wherein the time and temperature at which said artificial aging is performed results in underaging of said alloy to a yield strength at least 5 ksi below the peak yield strength that said alloy is capable of attaining.

8. A method according to claim 1, wherein said artificial aging is performed at a temperature of from 125° to 150° C.

9. A method according to claim 1, wherein said Cu comprises from 2.8 to 4.8 weight percent, said Li comprises from 0.4 to 1.5 weight percent, and furthermore comprises Mg in an amount from 0.2 to 1.0 weight percent of said alloy.

10. A method according to claim 2, wherein said Cu comprises from 2.8 to 4.8 weight percent, said Li comprises from 0.4 to 1.5 weight percent, and the aluminum base alloy furthermore comprises Mg in an amount from 0.2 to 1.0 weight percent of said alloy.

11. A method according to claim 9, wherein said aluminum-base alloy further contains at least one of Ag in an amount up to 0.8 weight percent and Zn in an amount up to 1.0 weight percent.

12. A method according to claim 10, wherein said aluminum-base alloy further contains at least one of Ag in an amount up to 0.8 weight percent and Zn in an amount up to 1.0 weight percent.

13. A method according to claim 4, wherein said Cu comprises from 3.0 to 4.5 weight percent, said Li comprises from 0.7 to 1.1 weight percent, said Mg comprises from 0.3 to 0.6 weight percent, and said grain refiner comprises from 0.08 to 0.3 weight percent of said alloy, wherein said grain refiner is selected from the group consisting of Zr, Ti, and combinations thereof.

14. A method according to claim 2, wherein said Cu comprises from 2.8 to 4.8 weight percent, said Li comprises from 0.4 to 1.5 weight percent, and the aluminum base alloy furthermore comprises Mg in an amount from 0.2 to 1.0 weight percent of said alloy.

15. A method according to claim 14, wherein said aluminum-base alloy further contains at least one of Ag in an amount up to 0.8 weight percent and Zn in an amount up to 1.0 weight percent.

16. A method according to claim 13, wherein said aluminum-base alloy further contains at least one of Ag in an amount up to 0.8 weight percent and Zn in an amount up to 1.0 weight percent.

17. A method according to claim 1, wherein the yield strength of said alloy at cryogenic temperature is greater than its yield strength at room temperature, which is greater than 85 ksi (longitudinal), and the plane strain fracture toughness of said alloy at cryogenic temperature is greater than its plane strain fracture toughness at room temperature, which is greater than 25 ksi√in.

18. A method according to claim 13, wherein the yield strength of said alloy at cryogenic temperature is greater than its yield strength at room temperature, which is greater than 85 ksi (longitudinal), and the plane strain fracture toughness of said alloy at cryogenic temperature is greater than its plane strain fracture toughness at room temperature, which is greater than 25 ksi√in.

19. A wrought aluminum-base alloy consisting essentially of from 2.8 to 4.8 weight percent Cu, from 0.4 to 1.5 weight percent Li, from 0.2 to 1.0 weigth percent Mg, and the balance aluminum and incidental impurities, wherein said alloy is worked, artificially aged, or worked and artificially aged an amount sufficient to provide strength and fracture toughness to said alloy at cryogenic temperature substantially equal to or greater than the strength and fracture toughness at room temperature, wherein the fracture toughness at room temperature is a least 18.7 ksi√in.

20. A wrought aluminum-base alloy according to claim 19, wherein said alloy further contains from 0.01 to 1.0 weight percent of at least one grain refiner selected from the group consisting of Zr, Ti, Cr, Mn, Hf, Nb, B, V, and $TiB_2$.

21. A wrought aluminum-base alloy according to claim 20, wherein said aluminum-base alloy further contains at least one of Ag in an amount up to 0.8 weight percent and Zn in an amount of up to 1.0 weight percent.

22. A wrought aluminum-base alloy according to claim 20, wherein said Cu comprises from 3.0 to 4.5 weight percent, said Li comprises from 0.7 to 1.1 weight percent, said Mg comprises from about 0.3 to about 0.6 weight percent, and said grain refiner comprises from 0.08 to 0.3 weight percent of said alloy, wherein said grain refiner is selected from the group consisting of Zr, Ti and combinations thereof.

23. A wrought aluminum-base alloy according to claim 21, wherein said Cu comprises from 3.0 to 4.5 weight percent, said Li comprises from 0.7 to 1.1 weight percent, said Mg comprises from about 0.3 to about 0.6 weight percent, and said grain refiner comprises from 0.08 to 0.3 weight percent of said alloy, wherein said grain refiner is selected from the group consisting of Zr, Ti, and combinations thereof.

24. A wrought aluminum-base alloy according to claim 20, wherein said Cu comprises from about 3.0 to about 4.5 weight percent of said alloy.

25. A wrought aluminum-base alloy according to claim 20, wherein said Li comprises from about 0.7 to about 1.1 weight percent of said alloy.

26. A wrought aluminum-base alloy according to claim 20, wherein said alloy is in the form of an extrusion.

27. A wrought aluminum-base alloy according to claim 20, wherein said alloy is in the form of a plate.

28. A wrought aluminum-base alloy according to claim 20, wherein said alloy is in the form of a sheet.

29. A wrought aluminum-base alloy according to claim 20, wherein the yield strength of said alloy at cryogenic temperature is substantially equal to greater than its yield strength at room temperature, which is greater than 85 ksi, and the plane strain fracture toughness of said alloy at cryogenic temperature is greater than its plane strain fracture toughness at room temperature, which is greater than 25 ksi√in.

30. A wrought aluminum-base alloy according to claim 20, wherein the yield strength of said alloy at cryogenic temperature is greater than its yield strength at room temperature, which is greater than 85 ksi, and the plane stress fracture toughness of said alloy at cryogenic temperature is greater than its plane stress fracture toughness at room temperature, which is greater than 25 ksi√in.

31. A wrought aluminum-base alloy according to claim 20, wherein said alloy is underaged to a yield strength at least 5 ksi below the peak yield strength that said alloy is capable of attaining.

32. A cryogenic material-holding container made from an alloy consisting essentially of from 2.8 to 4.5 weight percent Cu, from 0.4 to 1.5 weight percent Li, from 0.2 to 1.0 weight percent Mg, and the balance aluminum and incidental impurities, wherein said alloy is worked, artificially aged, or worked and artificially aged an amount sufficient to provide strength and fracture toughness to said alloy at cryogenic temperature substantially equal to or greater than the strength and fracture toughness at room temperature, wherein the fracture toughness at room temperature is at least 18.7 ksi√in and the fracture toughness at −196° C. is at least 19.2 ksi√in.

33. A cryogenic material-holding container according to claim 32, wherein said alloy further contains from 0.01 to 1.0 weight percent of at least one grain refiner selected from the group consisting of Zr, Ti, Cr, Mn, Hf, Nb, B, V, and $TiB_2$.

34. A cryogenic material-holding container according to claim 33, wherein said aluminum-base alloy further contains at least one of Ag in an amount up to 0.8 weight percent and Zn in an amount of up to 1.0 weight percent.

35. A cryogenic material-holding container according to claim 33, wherein the yield strength of said alloy at cryogenic temperature is greater than its yield strength at room temperature, which is greater than 85 ksi (longitudinal), and the plane strain fracture toughness of said alloy at cryogenic temperature is greater than its plane strain fracture toughness at room temperature, which is greater than 25 ksi√in.

36. A cryogenic material-holding container according to claim 33, wherein the yield strength of said alloy at cryogenic temperature is greater than its yield strength at room temperature, which is greater than 85 ksi (longitudinal), and the plane stress fracture toughness of said alloy at cryogenic temperature is greater than its plane stress fracture toughness at room temperature, which is greater than 25 ksi√in.

37. A cryogenic material-holding container according to claim 33, wherein said alloy is underaged to a yield strength at least about 5 ksi below the peak yield strength that said alloy is capable of attaining.

38. A cryogenic material-holding container according to claim 33, wherein said container has been formed by welding.

39. A cryogenic material-holding container according to claim 33, wherein said cryogenic material is selected from the group consisting of liquid hydrogen, liquid oxygen, and liquid nitrogen.

* * * * *

UNITED STATES PATENT AND TRADEMARK OFFICE

CERTIFICATE OF CORRECTION

PATENT NO. : 5,455,003

DATED : October 3, 1995

INVENTOR(S) : Joseph R. Pickens et al

It is certified that error appears in the above-indentified patent and that said Letters Patent is hereby corrected as shown below:

Column 2, line 12, "1.9-2.6)" should read --(1.9-2.6)--; line 38, delete the extra spaces between "max." and "Zn".

Column 7, line 57, after "C." (first occurrence) insert a comma (,); line 61, after "C." (first occurrence) insert a comma (,); line 64, after "C." insert a comma (,).

Column 8, line 24, "(16 h" should read --(16h--; line 35, after "C." insert a comma (,); line 46, "Ys" should read --YS--; line 57, "1 h" should read --1h--; line 67, "EXAMPLE 6" should be centered in column.

Column 9, line 15, "EXAMPLE 7" should be centered in column; line 30, "EXAMPLE 8" should be centered in column; line 41, after "C." insert a comma (,); line 46 "EXAMPLE 9" should be centered in column.

Column 10, line 3, after "C." insert a comma (,); line 59, after "C." insert a comma (,); line 66, after "C." insert a comma (,). (2nd Occur.

Column 12, line 46, "94 4" should read --94.4--; line 47, "28 4" should read --28.4--.

UNITED STATES PATENT AND TRADEMARK OFFICE

CERTIFICATE OF CORRECTION

PATENT NO. : 5,455,003

DATED : October 3, 1995

INVENTOR(S) : Joseph R. Pickens et al

It is certified that error appears in the above-indentified patent and that said Letters Patent is hereby corrected as shown below:

Column 14, line 34, "1 12%" should read --1.12%--; line 38, after "III)" insert a period (.); line 53, after "III)" insert a period (.); line 58, delete the extra spaces between "composition" and "Al".

Column 17, line 55, after "1%" insert a comma --, as--; line 56, "e g , 2.7%" should read --e.g., 2.7%,".

Column 21, lines 20 and 21, "14/min" should read --14 l/min--; line 61, "40" should read --4.0--.

Column 23, line 14, before the period (.) add --and the fracture toughness at -196$^{o}$C is at least 19.2 ksi$\sqrt{in}$--.

Signed and Sealed this

Fifth Day of March, 1996

Bruce Lehman

*Attest:*

BRUCE LEHMAN

*Attesting Officer*

*Commissioner of Patents and Trademarks*